US011326413B2

(12) United States Patent
Li et al.

(10) Patent No.: US 11,326,413 B2
(45) Date of Patent: May 10, 2022

(54) WIRE-LINE CORE DRILLING TOOL

(71) Applicant: INSTITUTE OF EXPLORATION TECHNIQUES, CHINESE ACADEMY OF GEOLOGICAL SCIENCES, Tianjin (CN)

(72) Inventors: Xinmiao Li, Tianjin (CN); Jian Liang, Tianjin (CN); Kuan Li, Tianjin (CN); Hao Yin, Tianjin (CN); Xiumei Liu, Tianjin (CN)

(73) Assignee: INSTITUTE OF EXPLORATION TECHNIQUES, CHINESE ACADEMY OF GEOLOGICAL SCIENCES, Tianjin (CN)

( * ) Notice: Subject to any disclaimer, the term of this patent is extended or adjusted under 35 U.S.C. 154(b) by 0 days.

(21) Appl. No.: 17/418,265

(22) PCT Filed: Sep. 16, 2020

(86) PCT No.: PCT/CN2020/115618
§ 371 (c)(1),
(2) Date: Jun. 25, 2021

(87) PCT Pub. No.: WO2021/253655
PCT Pub. Date: Dec. 23, 2021

(65) Prior Publication Data

US 2022/0098948 A1 Mar. 31, 2022

(30) Foreign Application Priority Data

Jun. 17, 2020 (CN) ..... 202010554463.8

(51) Int. Cl.
*E21B 25/02* (2006.01)
*E21B 47/00* (2012.01)
(Continued)

(52) U.S. Cl.
CPC ..... *E21B 25/02* (2013.01); *E21B 25/10* (2013.01); *E21B 34/14* (2013.01); *E21B 47/00* (2013.01); *E21B 2200/06* (2020.05)

(58) Field of Classification Search
CPC ..... E21B 25/00; E21B 25/02; E21B 25/04; E21B 25/06; E21B 25/10; E21B 34/14; E21B 47/00; E21B 2200/06
See application file for complete search history.

(56) References Cited

U.S. PATENT DOCUMENTS 9,637,987 B2 5/2017 Kang et al.
2013/0105227 A1* 5/2013 Drenth ..... E21B 25/02 175/246
2020/0181998 A1* 6/2020 Ye ..... E21B 25/18

FOREIGN PATENT DOCUMENTS

CN 102418488 A 4/2012
CN 108625807 A 10/2018
(Continued)

*Primary Examiner* — Brad Harcourt
(74) *Attorney, Agent, or Firm* — Bayramoglu Law Offices LLC

(57) ABSTRACT

A wire-line core drilling tool includes an outer barrel assembly and an inner barrel assembly. The inner barrel assembly is provided with an elastic clamp positioning mechanism, an in-place reporting and core blockage alarm mechanism, a single-action mechanism, a core barrel check valve mechanism, a core barrel and a core-breaking mechanism. The elastic clamp positioning mechanism adopts a multi-point hinged mode. The in-place reporting and core blockage alarm mechanism is integrally formed. The single-action mechanism adopts a cooperating structure of an upper polycrystalline diamond compact (PDC) bearing, a lower PDC bearing and a tungsten carbide (TC) bearing arranged in the middle. The outer barrel assembly is provided with an elastic clamp retaining head, an elastic clamp chamber, an
(Continued)

upper reamer, an outer barrel, a lower reamer and a drill bit.
A ring base is arranged, and a centralizing ring is arranged.

9 Claims, 22 Drawing Sheets

(51) Int. Cl.
*E21B 25/10* (2006.01)
*E21B 34/14* (2006.01)

(56) References Cited

FOREIGN PATENT DOCUMENTS

| | | | |
|---|---|---|---|
| CN | 109025873 | A | 12/2018 |
| CN | 109025876 | A | 12/2018 |
| EP | 2354438 | A1 | 8/2011 |

* cited by examiner

WIRE-LINE CORE DRILLING TOOL

CROSS REFERENCE TO THE RELATED APPLICATIONS

This application is the national phase entry of International Application No. PCT/CN2020/115618, filed on Sep. 16, 2020, which is based upon and claims priority to Chinese Patent Application No. 202010554463.8, filed on Jun. 17, 2020, the entire contents of which are incorporated herein by reference.

TECHNICAL FIELD

The present invention relates to a wire-line core drilling tool, and more particularly, to a wire-line core drilling tool suitable for extra-deep scientific drilling.

BACKGROUND

In order to master underground geological conditions, people usually use the way of coring by drilling exploration to obtain real and reliable underground rock formation data. Wire-line coring is widely used in a variety of drilling engineering fields such as geological exploration, hydrogeology and engineering investigation due to its advantages of high drilling efficiency, low cost and few drilling accidents. At present, the wire-line core drilling tools have been standardized and serialized.

Extra-deep scientific drilling is a kind of scientific exploration activity that obtains cores from extra-deep holes and uses them to carry out geological research. In order to improve the drilling efficiency of coring and core recovery quality, as well as to save drilling exploration costs, those conducting extra-deep scientific drilling exploration typically use the wire-line core drilling process. Influenced by a depth of a drill hole and the stratigraphic structure, the drilling conditions at the bottom of the hole may be very complicated during the construction of extra-deep scientific drilling, so the wire-line core drilling tool requires a more optimized design in terms of reliability (including the reliability of various aspects such as dropping, placing, drilling, salvage and the earth's surface core upon exiting). Meanwhile, in order to meet the requirements of the drilling process and improve the strength of the drill rod, it is also necessary to increase an outer diameter of the drill rod, a wall thickness of the outer barrel and an outer diameter of the drill bit. However, the prior wire-line core drilling tools have certain shortcomings in their structural components in terms of the cooperation of the inner and outer assemblies as well as the positioning, in-place reporting, core blockage alarm, single-action mechanism and core barrel check valve of the inner assembly, mainly in the following aspects. First, an elastic clamp positioning mechanism of the inner assembly adopts a single-point hinged mode, which frequently causes the elastic clamp to stick when the core barrel is blocked. As a result, the elastic clamp cannot be recovered and the salvage of the inner barrel assembly fails. Second, an in-place reporting mechanism and a core blockage alarm mechanism for the wire-line core drilling tool are set independently, which makes for a large number of components and makes the in-place reporting and core blockage alarm prompt unreliable. The in-place reporting mechanism and the core blockage alarm mechanism have limiting structures, and thus have problems such as single barrel drilling and large core loss during drilling. Third, the way the steel ball and the fixed valve base cooperate is employed in the core barrel check valve mechanism. Because of the structure of internal taper of the cooperation of the valve base and the steel ball is small, the steel ball is attached to the fixed ball base during the earth's surface core exiting job, resulting in negative pressure inside the core barrel, which increases the core exiting difficulty and job time. Fourth, in the single-action mechanism, the way in which the upper and lower thrust ball bearings cooperate, while the outer diameter of the drill rod of the extra-deep hole drilling tool is enlarged in design, the corresponding lip plane of the drill bit is also enlarged, the corresponding drilling pressure increases during the drilling process of the drilling tool, and the force fed back to the upper thrust bearing increases at the same time when the core is blocked. In addition, due to the complex job conditions at the bottom of the hole, the thrust ball bearing is prone to damage under the action of large load and alternating stress, resulting in single-action failure, causing wear and disturbance of the core barrel to the drilled core. Fifth, in the core-breaking mechanism, an open elastic retaining ring is placed in an annular groove of a clamp spring base. The ring is configured to axially limit the clamp spring. Since the disassembly process of the retaining ring is time-consuming, the retaining ring is generally not used in field operation. During drilling, the clamp spring tightly clamps the core and moves up, and uses the end portion of the core barrel to limit the position, which easily causes the wear failure of the end portion of the core barrel.

SUMMARY

The present invention provides a wire-line core drilling tool to optimize the design of the cooperating structure of the inner and outer assemblies as well as the positioning mechanism, the in-place reporting and core blockage alarm mechanism, the single-action mechanism, the core barrel check valve mechanism and the core-breaking mechanism in the inner assembly, so as to improve the reliability of the wire-line core drilling tool, increase the strength of the drilling tool, and achieve the objectives of improving the core drilling efficiency and the core recovery quality and saving the drilling exploration cost.

To achieve the above objectives, the present invention adopts the following technical solutions.

A wire-line core drilling tool includes an outer barrel assembly and an inner barrel assembly. The inner barrel assembly is, from top to bottom, successively provided with an elastic clamp positioning mechanism, an in-place reporting and core blockage alarm mechanism, a single-action mechanism, a core barrel check valve mechanism, a core barrel and a core-breaking mechanism. The elastic clamp positioning mechanism adopts a multi-point hinged mode. The in-place reporting and core blockage alarm mechanism is integrally formed. The single-action mechanism adopts a cooperating structure of an upper polycrystalline diamond compact (PDC) bearing, a lower PDC bearing and a tungsten carbide (TC) bearing arranged in the middle. The core barrel check valve mechanism controls an opening and a closing of a check valve through a cooperation between a steel ball and a liftable valve base. During a drilling of the drilling tool, the inner barrel assembly is placed in the outer barrel assembly, and during a coring operation, the inner barrel assembly is lifted from the outer barrel assembly to the ground by a salvage device. The outer barrel assembly is provided with an elastic clamp retaining head, an elastic clamp chamber, an upper reamer, an outer barrel, a lower reamer and a drill bit, which are successively assembled from top to bottom. A ring base is embedded in an annular groove formed between a lower end of the elastic clamp chamber and an inner side wall of the upper reamer, and a centralizing ring is embedded in an annular groove formed between a lower end of the outer barrel and an inner side wall of the lower reamer. The elastic clamp retaining head, the elastic clamp chamber and the ring base cooperate with the elastic clamp positioning mechanism in the inner barrel assembly to switch a locking state and an unlocking state of the inner barrel assembly and the outer barrel assembly.

According to the aforementioned wire-line core drilling tool, the elastic clamp positioning mechanism of the inner barrel assembly includes a spear head component, a recovery barrel, an elastic clamp rack, an elastic clamp limit block, an elastic caliper, an elastic clamp base and a support plate. An upper end of the recovery barrel is assembled with the spear head component. The elastic clamp rack is sleeved in the recovery barrel, and two elastic caliper avoidance holes are symmetrically disposed in a side wall of the recovery barrel. The elastic clamp rack is a sleeve with axial long holes formed on both sides. The bottom of the elastic clamp rack is fixedly assembled with the in-place reporting and core blockage alarm mechanism. The elastic clamp limit block, the elastic caliper, the elastic clamp base and the support plate are arranged in the elastic clamp rack, and each of the elastic clamp limit block, the elastic caliper and the support plate includes two symmetrical parts on the left and right. Left and right parts of the elastic clamp limit block are hinged together through an elastic clamp limit block hinge shaft, and two ends of the elastic clamp limit block hinge shaft are mounted on the side wall of the recovery barrel. The left and right parts of the elastic clamp limit block are further hinged and assembled with left and right parts of the elastic caliper, respectively. The left and right parts of the elastic caliper are hinged together through an elastic caliper hinge shaft, and the elastic caliper hinge shaft is assembled with the elastic clamp base. In an opening state of the elastic caliper, outer edges of the left and right parts of the elastic caliper pass through the elastic caliper avoidance holes in the side wall of the recovery barrel and are clamped in a clamp groove of the elastic clamp chamber of the outer barrel assembly of the wire-line core drilling tool. The elastic clamp base can move up and down along a central axis of the elastic clamp rack, and a lower end of the elastic clamp base is in contact with the support plate. Left and right parts of the support plate are hinged together through a support plate hinge shaft, and the support plate hinge shaft is assembled with the elastic clamp rack. An upper end of the support plate is provided with a wedge face matched with the lower end of the elastic clamp base.

According to the aforementioned wire-line core drilling tool, the in-place reporting and core blockage alarm mechanism includes a valve core, a positioning sleeve, a valve stem, a water diversion sleeve, a lower limit block, an elastic clamp claw, a limit sleeve, a sliding sleeve, a torsion transmission joint, an adjusting bolt and a core blockage alarm spring. A high-pressure overflow loop and a low-pressure overflow loop connected to a mud pump are disposed in a drilling fluid circulation system. The valve core is a plunger fixed on an upper end of the valve stem, and the diameter of the outer cylindrical face of the valve core is matched with the inner diameter of an upper portion of the water diversion sleeve. An upper end of the water diversion sleeve is assembled with the elastic clamp positioning mechanism, and a lower end of the water diversion sleeve is connected to the single-action mechanism through the torsion transmission joint and the adjusting bolt. A side wall of the upper end of the water diversion sleeve is provided with an overflow hole in communication with a drilling fluid channel. The valve stem is placed inside the water diversion sleeve. The positioning sleeve, the core blockage alarm spring, the lower limit block and the elastic clamp claw are successively arranged in an annular space between the valve stem and the water diversion sleeve from top to bottom. The valve stem moves up and down in the water diversion sleeve to drive the valve core to switch a blocking state and an opening state of the overflow hole in the water diversion sleeve. The sliding sleeve is sleeved outside the elastic clamp claw. The limit sleeve is fitted between the sliding sleeve and the elastic clamp claw, and an elastic force of the elastic clamp claw is controlled through the limit sleeve.

According to the aforementioned wire-line core drilling tool, the single-action mechanism includes a mandrel, the upper PDC bearing, a bearing protective cover, a single-action joint, the TC bearing, a TC bearing limit member, the lower PDC bearing, a positioning half-ring, and a connecting sleeve. The mandrel is assembled with the adjusting bolt of the in-place reporting and core blockage alarm mechanism. The upper PDC bearing, the single-action joint, the TC bearing, the TC bearing limit member, the lower PDC bearing and the positioning half-ring are sleeved outside the mandrel. A protective gasket is disposed at each of an upper end and a lower end of the upper PDC bearing. The bearing protective cover is disposed outside the upper PDC bearing and the protective gasket. The single-action joint, the connecting sleeve, the upper PDC bearing, the TC bearing and the lower PDC bearing are fitted. A lower end of the connecting sleeve is fixedly connected to the core barrel check valve mechanism.

According to the aforementioned wire-line core drilling tool, the core barrel check valve mechanism includes a core barrel joint, a thrust sleeve, a liftable valve base, a cylindrical pin and a steel ball. The core barrel joint is provided with an inner hole penetrating vertically and a liquid discharge hole penetrating perpendicularly to the inner hole. An upper end and a lower end of the core barrel joint are assembled with the single-action mechanism and the core barrel, respectively. The thrust sleeve is sleeved outside the core barrel joint, and two cylindrical pin avoidance holes are symmetrically disposed in the middle portion of a side wall of the core barrel joint. The thrust sleeve is cylindrical, and the cylindrical pin is fitted on the thrust sleeve. Two ends of the cylindrical pin pass through the cylindrical pin avoidance holes of the core barrel joint and are then assembled with pin holes disposed in a side wall of the thrust sleeve. The liftable valve base is a sleeve, and a lower end of the liftable valve base is provided with a tapered opening. The liftable valve base is placed in the inner hole of the core barrel joint and can move up and down axially. A side wall of the liftable valve base is provided with an axial long hole. When the liftable valve base is in a lower level, the axial long hole is in communication with the liquid discharge hole at a lower portion of the core barrel joint. The steel ball is placed in the liftable valve base, and the steel ball cooperates with the tapered opening at the lower end of the liftable valve base to realize a sealing function.

According to the aforementioned wire-line core drilling tool, the core-breaking mechanism includes a retaining ring, a clamp spring and a clamp spring base. The clamp spring base is a sleeve fixedly connected to a lower end of the core barrel. A lower portion of an inner side wall of the clamp spring base is a tapered face matched with the clamp spring. The clamp spring is fitted in the clamp spring base, and the retaining ring is arranged above the clamp spring. The retaining ring is an enclosed ring structure, and the clamp spring is axially limited through the retaining ring.

According to the aforementioned wire-line core drilling tool, a set of circumferentially arranged centralizing steel balls is fitted in the centralizing ring of the outer barrel assembly, and a centralizing steel ball limit sleeve is disposed outside the centralizing steel balls.

According to the aforementioned wire-line core drilling tool, the length of the inner barrel assembly is adjusted by a cooperation between the adjusting bolt in the in-place reporting and core blockage alarm mechanism and the mandrel in the single-action mechanism.

The present invention provides a wire-line core drilling tool, which optimizes the design of the cooperating structure of the inner assembly and the outer assembly as well as the positioning mechanism, the in-place reporting and core blockage alarm mechanism, the single-action mechanism and the core barrel check valve mechanism in the inner assembly. Specifically, the elastic clamp positioning mechanism adopts a multi-point hinged mode, which solves the problem that the elastic caliper and the elastic clamp retaining head are fully stuck under the condition of core barrel blockage, so that the elastic clamp can be recovered inward, and the salvage job of the inner barrel assembly can be successfully completed in the drilling process of complex strata. The in-place reporting and core blockage alarm mechanism is integrally formed, which not only reduces the number of components, but also avoids the phenomenon of single barrel drilling in the drilling process, reduces the core loss, and improves the reliability of the in-place reporting and core blockage alarm prompt. The single-action mechanism adopts a cooperating structure of an upper PDC bearing, a lower PDC bearing and a TC bearing arranged in the middle, which solves the problem of single-action failure caused by bearing damage under the action of large load and alternating stress, and avoids the wear and disturbance of the core barrel to the drilled core. The core barrel check valve mechanism controls the opening and closing of the check valve through the cooperation of the steel ball and the liftable valve base, which not only ensures the core quality and core recovery rate, but also reduces the difficulty of core discharge and shortens the job time of the core discharge. The core-breaking mechanism adopts an annular retaining ring, which is convenient for disassembly and assembly operations. Accordingly, the present invention improves the use reliability of the wire-line core drilling tool, increases the strength of the drilling tool, and achieves the objectives of improving the core drilling efficiency and the core recovery quality and saving the drilling exploration cost.

1. elastic clamp positioning mechanism

Figure 1:
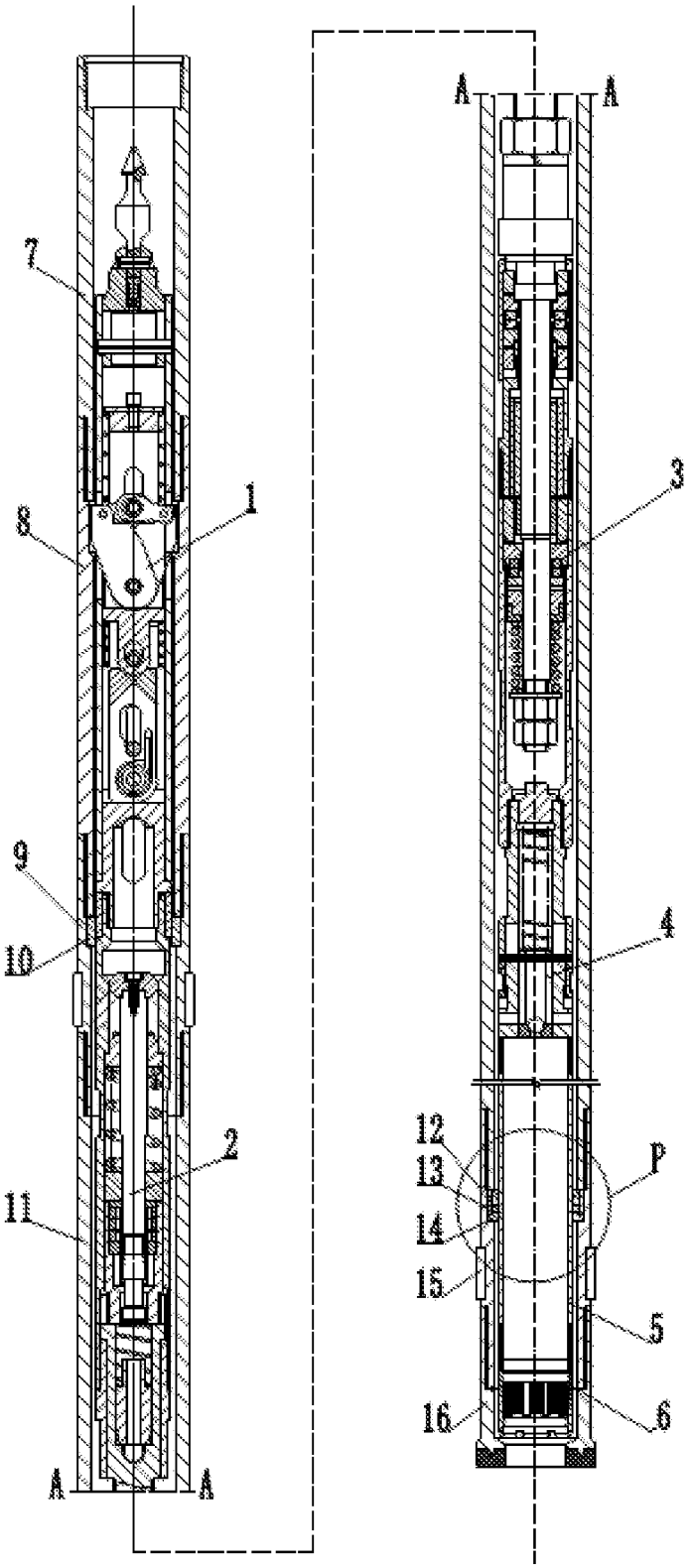
FIG. 1 is a schematic diagram of an overall structure of a wire-line core drilling tool of the present invention.

1-1. spear head component, 1-2. recovery barrel, 1-2-1. first assembly hole, 1-2-2. second assembly hole, 1-2-3. elastic caliper avoidance hole, 1-2-4. third assembly hole, 1-3. pressure plate, 1-4. elastic clamp rack, 1-4-1. elastic clamp limit block hinge shaft vertical movement avoidance hole, 1-4-2. elastic clamp base vertical movement limit pin mounting hole, 1-4-3. recovery barrel guide pin mating hole, 1-4-4. support plate hinge shaft mounting hole, 1-4-5. annular stepped end face, 1-4-6. axial long hole, 1-5. elastic clamp limit block, 1-6. elastic caliper, 1-6-1. elastic caliper upper end face, 1-7. elastic clamp base, 1-8. support plate, 1-8-1. wedge face, 1-8-2. recovery barrel guide pin avoidance hole, and 1-9. suspension ring;

2. in-place reporting and core blockage alarm mechanism

2-1. valve core, 2-2. positioning sleeve, 2-3. valve stem, 2-3-1. annular limit face, 2-3-2. upper annular clamp groove, 2-3-3. tapered transition face, 2-3-4. annular boss, 2-3-5. lower annular clamp groove, 2-4. water diversion sleeve, 2-4-1. overflow hole, 2-4-2. positioning boss, 2-5. lower limit block, 2-6. adjusting sleeve, 2-7. limit sleeve, 2-8. elastic clamp claw, 2-8-1. disk-like flange, 2-8-2. clamp monomer, 2-8-3. slicing slit,

2-8-4. chuck, 2-9. sliding sleeve, 2-10. adjusting bolt, 2-11. torsion transmission joint;

3. single-action mechanism

3-1. mandrel, 3-2. protective gasket, 3-3. upper PDC bearing, 3-4. lower PDC bearing, 3-5. bearing protective cover, 3-6. single-action joint, 3-7. TC bearing, 3-8. TC bearing limit member, 3-9. positioning half-ring, 3-10. connecting sleeve;

4. core barrel check valve mechanism

4-1. plug, 4-2. core barrel joint, 4-2-1. installation tool clamping face, 4-2-2. cylindrical pin avoidance hole, 4-2-3. high-level slot, 4-2-4. liquid discharge hole, 4-2-5. low-level slot, 4-2-6. annular sealing groove, 4-2-7. inner hole, 4-3. thrust sleeve, 4-3-1. rectangular holding groove, 4-3-2. pin hole, 4-4. transposition sleeve, 4-4-1. annular holding groove, 4-4-2. positioning insert block, 4-5, liftable valve base, 4-5-1. axial long hole, 4-5-2. tapered opening, 4-6. elastic sealing ring, 4-7. cylindrical pin, 4-8. steel ball;

5. core barrel

6. core-breaking mechanism

6-1. retaining ring, 6-2. clamp spring, 6-3. clamp spring base;

7. elastic clamp retaining head

8. elastic clamp chamber

9. upper reamer

10. ring base

11. outer barrel

12. centralizing steel ball

13. centralizing steel ball limit sleeve

14. centralizing ring

15. lower reamer

16. drill bit

B1. elastic cylindrical pin, B2. elastic clamp limit block hinge shaft, B3. elastic caliper hinge shaft, B4. elastic clamp base vertical movement limit pin, B5. recovery barrel guide pin, B6. support plate hinge shaft, W1. elastic caliper reset spring, W2. elastic clamp base reset spring, W3. support plate reset clamp spring, W4. core blockage alarm spring, W5. liftable valve base reset spring.

DETAILED DESCRIPTION OF THE EMBODIMENTS

The present invention will be further explained below in conjunction with the drawings and specific embodiments.

Figure 2:
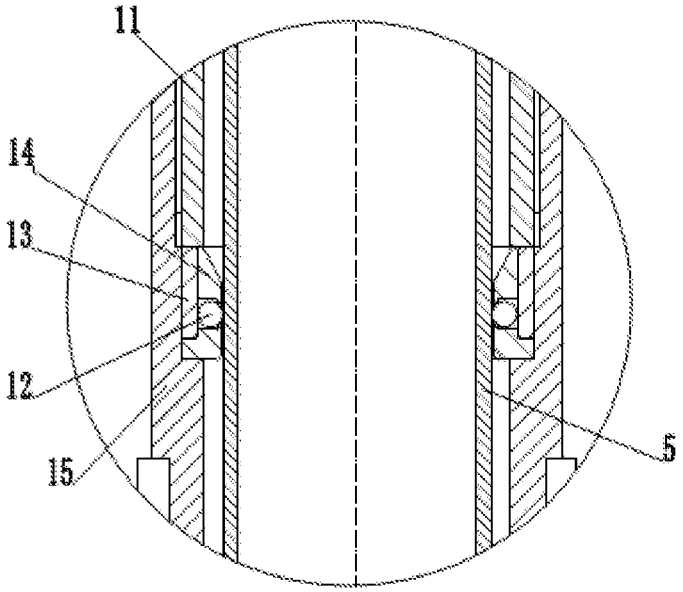
FIG. 2 is an enlarged view of the structure of the portion P circled in FIG. 1.

Referring to FIGS. 1 and 2, the present invention provides a wire-line core drilling tool, which includes an outer barrel assembly and an inner barrel assembly. The inner barrel assembly is, from top to bottom, successively provided with the elastic clamp positioning mechanism 1, the in-place reporting and core blockage alarm mechanism 2, the single-action mechanism 3, the core barrel check valve mechanism 4, the core barrel 5 and the core-breaking mechanism 6. The elastic clamp positioning mechanism 1 adopts a multi-point hinged mode. The in-place reporting and core blockage alarm mechanism 2 is integrally formed. The single-action mechanism 3 adopts a cooperating structure of an upper PDC bearing, a lower PDC bearing and a TC bearing arranged in the middle. The core barrel check valve mechanism 4 controls opening and closing of the check valve through the cooperation between a steel ball and a liftable valve base. During drilling of the drilling tool, the inner barrel assembly is placed in the outer barrel assembly, and during the coring operation, the inner barrel assembly is lifted from the outer barrel assembly to the ground by a salvage device. The outer barrel assembly is provided with the elastic clamp retaining head 7, the elastic clamp chamber 8, the upper reamer 9, the outer barrel 11, the lower reamer 15 and the drill bit 16, which are successively assembled from top to bottom. The ring base 10 is embedded in an annular groove formed between the lower end of the elastic clamp chamber 8 and the inner side wall of the upper reamer 9. The centralizing ring 14 is embedded in an annular groove formed between the lower end of the outer barrel 11 and the inner side wall of the lower reamer 15. A set of circumferentially arranged centralizing steel balls 12 is fitted in the centralizing ring 14, and meanwhile, the centralizing steel ball limit sleeve 13 is disposed outside the centralizing steel balls 12, so that the centralizing steel balls 12 centralizes the core barrel 5 in the inner barrel assembly, while reducing a friction resistance between the outer barrel 11 and the core barrel 5, which improves single-action performance of the core barrel 5, further reduces wear and disturbance of the core barrel 5 on the core, and improves the core recovery quality. The elastic clamp retaining head 7, the elastic clamp chamber 8 and the ring base 10 in the outer barrel assembly cooperate with the elastic clamp positioning mechanism 1 in the inner barrel assembly to switch a locking state and an unlocking state of the inner barrel assembly and the outer barrel assembly.

Referring to FIGS. 3 to 7, according to the wire-line core drilling tool of the present invention, the elastic clamp positioning mechanism 1 of the inner barrel assembly thereof includes the spear head component 1-1, the recovery barrel 1-2, the elastic clamp rack 1-4, the elastic clamp limit block 1-5, the elastic caliper 1-6, the elastic clamp base 1-7 and the support plate 1-8. The upper end of the recovery barrel 1-2 is assembled with the spear head component 1-1. The elastic clamp rack 1-4 is sleeved in the recovery barrel 1-2, and two elastic caliper avoidance holes 1-2-3 are symmetrically disposed in the side wall of the recovery barrel 1-2. The elastic clamp rack 1-4 is a sleeve with axial long holes 1-4-6 formed on both sides. The bottom of the elastic clamp rack 1-4 is fixedly assembled with the in-place reporting and core blockage alarm mechanism 2. The elastic clamp limit block 1-5, the elastic caliper 1-6, the elastic clamp base 1-7 and the support plate 1-8 are arranged in the elastic clamp rack 1-4. Each of the elastic clamp limit block 1-5, the elastic caliper 1-6 and the support plate 1-8 includes two symmetrical parts on the left and right. The left and right parts of the elastic clamp limit block 1-5 are hinged together. Two ends of the elastic clamp limit block hinge shaft are mounted on the side wall of the recovery barrel 1-2. The left and right parts of the elastic clamp limit block 1-5 are further hinged and assembled with left and right parts of the elastic caliper 1-6, respectively. The left and right parts of the elastic caliper 1-6 are hinged together. The elastic caliper hinge shaft is assembled with the elastic clamp base 1-7. In the opening state of the elastic caliper 1-6, outer edges of the left and right parts of the elastic caliper 1-6 pass through the elastic caliper avoidance holes 1-2-3 in the side wall of the recovery barrel 1-2 and are clamped in a clamp groove of the elastic clamp chamber 8 of the outer barrel assembly of the wire-line core drilling tool. The elastic clamp base 1-7 can move up and down along the central axis of the elastic clamp rack, and the lower end of the elastic clamp base 1-7 is in contact with the support plate 1-8. Left and right parts of the support plate 1-8 are hinged together. The support plate hinge shaft is assembled with the elastic clamp rack 1-4. The upper end of the support plate 1-8 is provided with the wedge face 1-8-1 matched with the lower end of the elastic clamp base 1-7.

Figure 3:
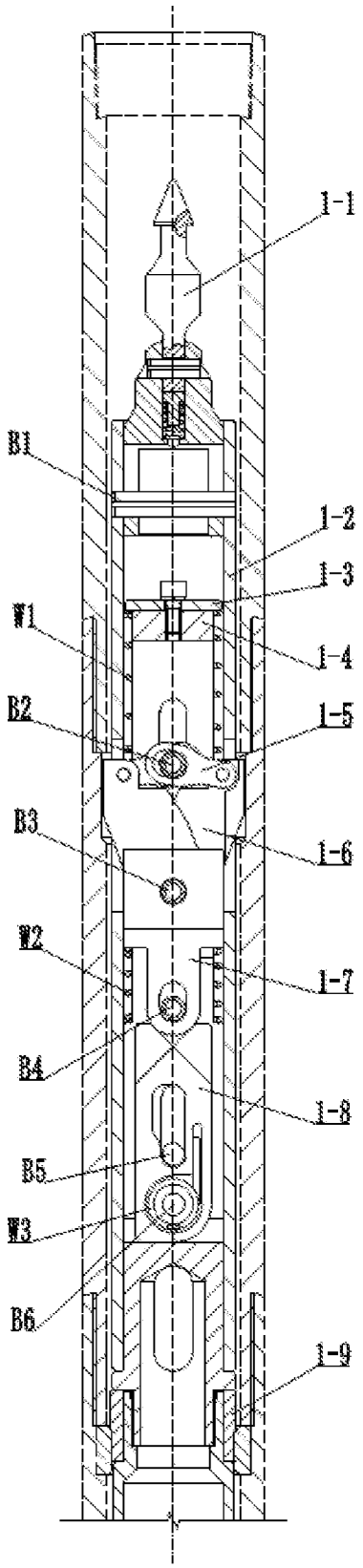
FIG. 3 is a schematic diagram of an elastic clamp positioning mechanism.
Figure 4:
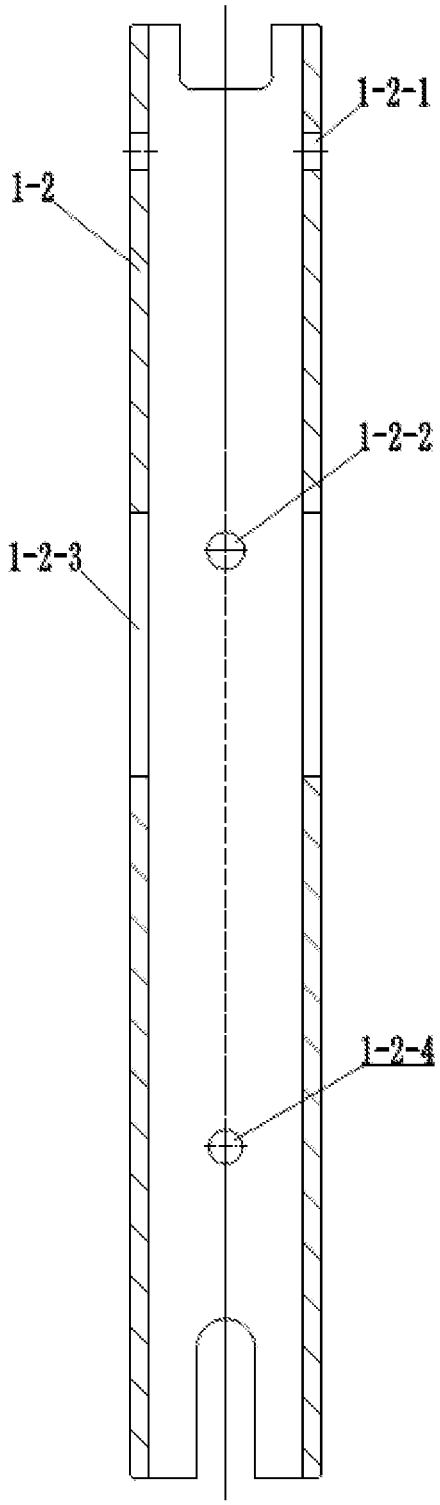
FIG. 4 is a schematic diagram of the structure of a recovery barrel in the elastic clamp positioning mechanism.

Referring to FIGS. 3 and 4, according to the elastic clamp positioning mechanism of the inner barrel assembly of the wire-line core drilling tool of the present invention, the first assembly hole 1-2-1, the second assembly hole 1-2-2 and the third assembly hole 1-2-4 are further disposed in the side wall of the recovery barrel 1-2 of the elastic clamp positioning mechanism. The first assembly hole 1-2-1 is configured to receive the elastic cylindrical pin B1, by which the recovery barrel 1-2 and the spear head component 1-1 are hinged. The second assembly hole 1-2-2 is configured to receive the elastic clamp limit block hinge shaft B2. The third assembly hole 1-2-4 is configured to receive the recovery barrel guide pin B5 which guides the recovery barrel 1-2 to move up and down during the lowering and recovery processes of the inner barrel assembly.

Figure 5:
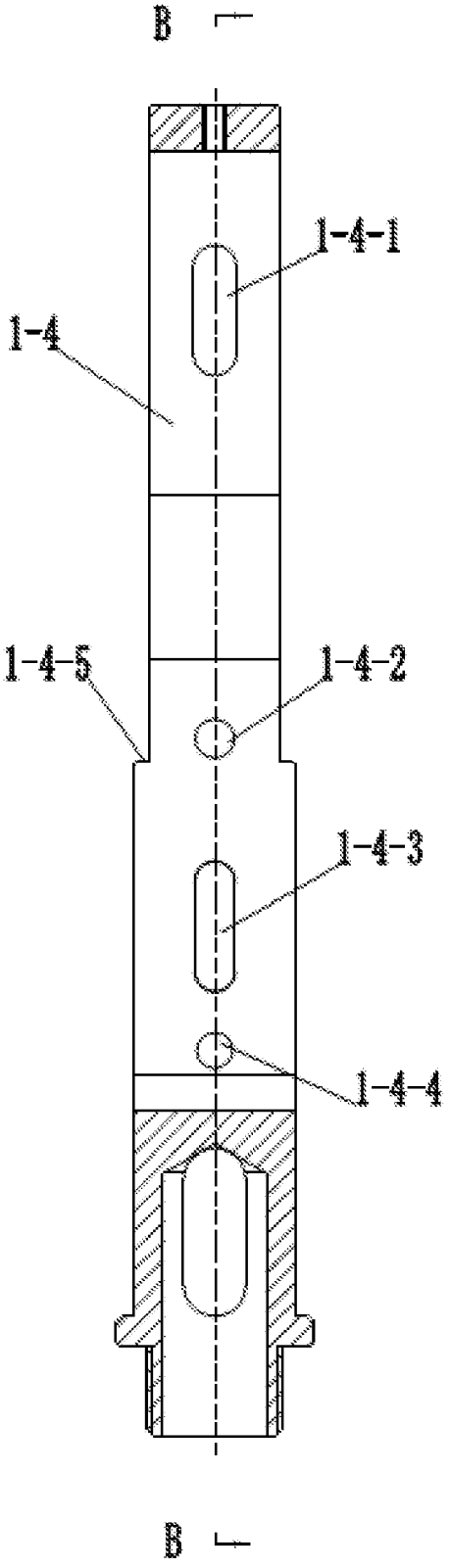
FIG. 5 is a schematic diagram of the structure of an elastic clamp rack in the elastic clamp positioning mechanism.
Figure 6:
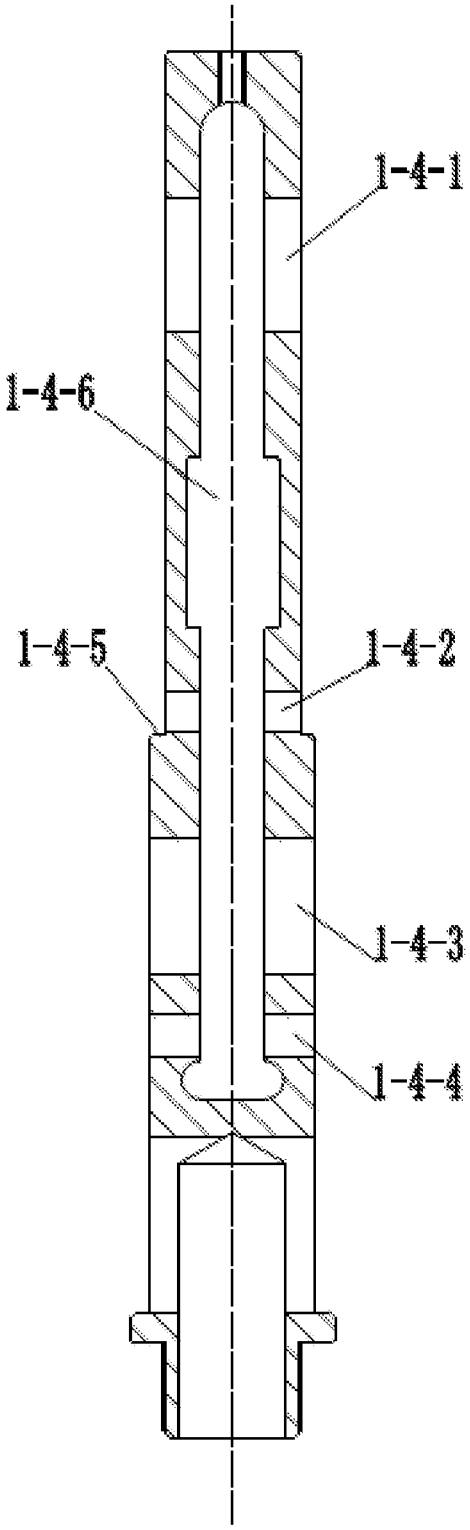
FIG. 6 is a cross-sectional view of the structure along B-B in FIG. 5.

Referring to FIGS. 3, 5 and 6, according to the elastic clamp positioning mechanism of the inner barrel assembly of the wire-line core drilling tool of the present invention, the elastic clamp rack 1-4 of the elastic clamp positioning mechanism is further provided with the elastic clamp limit block hinge shaft vertical movement avoidance hole 1-4-1, the elastic clamp base vertical movement limit pin mounting hole 1-4-2, the recovery barrel guide pin mating hole 1-4-3, and the support plate hinge shaft mounting hole 1-4-4. The elastic clamp limit block hinge shaft vertical movement avoidance hole 1-4-1, the elastic clamp base vertical movement limit pin mounting hole 1-4-2, the recovery barrel guide pin mating hole 1-4-3, and the support plate hinge shaft mounting hole 1-4-4 are successively arranged along the central axis of the elastic clamp rack 1-4 from top to bottom.

Figure 7:
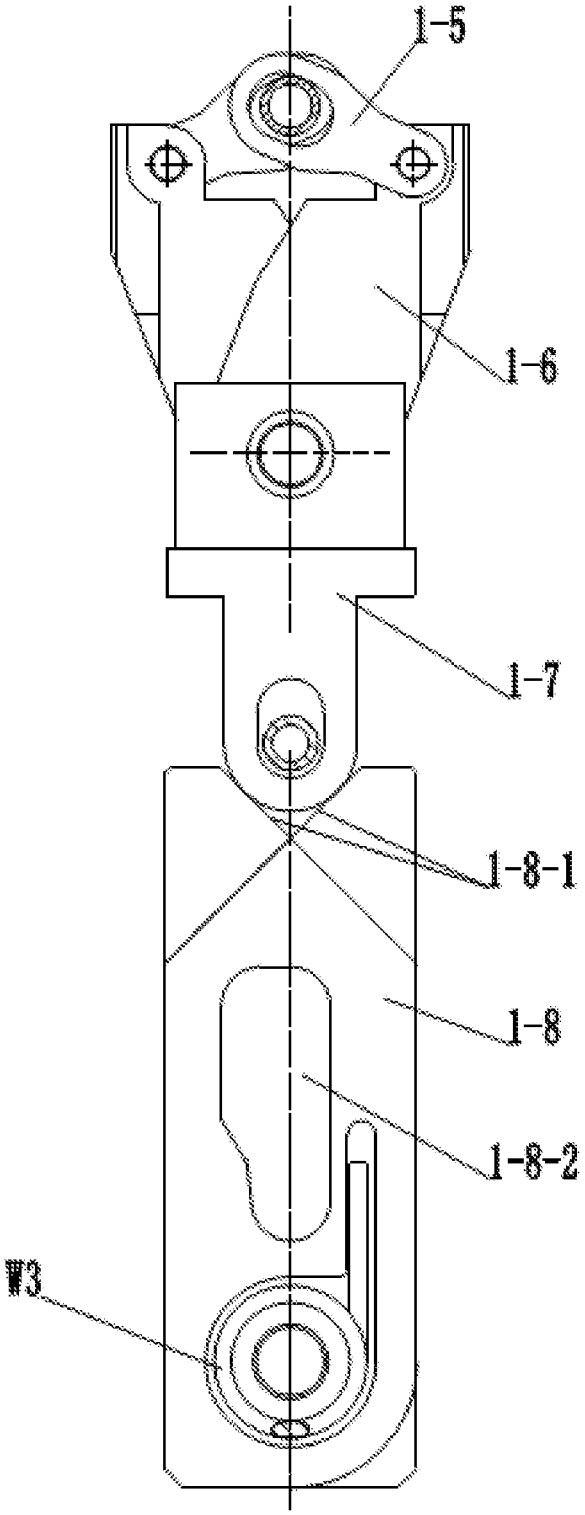
FIG. 7 is a schematic diagram of an assembly structure of an elastic caliper, an elastic caliper limit block, an elastic clamp base and a support plate.
Figure 8:
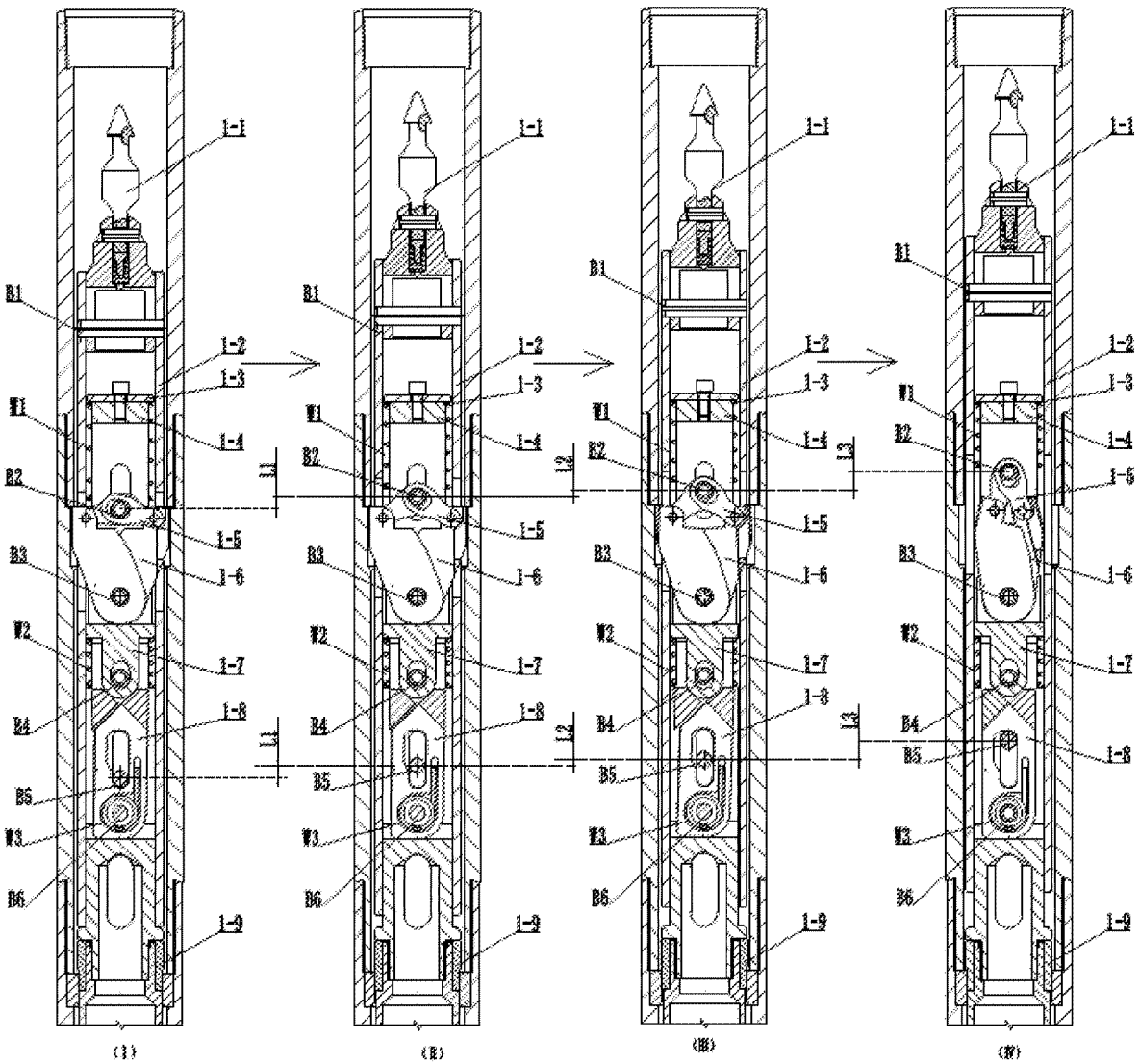
FIG. 8 is a schematic diagram of a working process of an elastic clamp positioning mechanism.

Referring to FIGS. 3 and 7, according to the elastic clamp positioning mechanism of the inner barrel assembly of the wire-line core drilling tool of the present invention, when the elastic caliper 1-6 is in an opening state, the outer edges of the left and right parts of the elastic caliper 1-6 pass through the elastic caliper avoidance holes 1-2-3 in the side wall of the recovery barrel 1-2 and are clamped in the clamp groove of the elastic clamp chamber 8 of the outer barrel assembly of the wire-line core drilling tool. The elastic clamp positioning mechanism of the inner barrel assembly of the wire-line core drilling tool of the present invention is further provided with an elastic caliper reset assembly. The elastic caliper reset assembly includes the pressure plate 1-3 and the elastic caliper reset spring W1. The pressure plate 1-3 is fixed on the top of the elastic clamp rack 1-4, and the elastic caliper reset spring W1 is sleeved outside the elastic clamp rack 1-4. The upper and lower ends of the elastic caliper reset spring W1 abut against the pressure plate 1-3 and the elastic clamp limit block hinge shaft B2, respectively. The elastic clamp base 1-7 is provided with an elastic caliper mounting portion and a vertical movement guide portion. The elastic caliper mounting portion is a rectangular groove structure, and the left and right parts of the elastic caliper 1-6 are fitted in the rectangular groove. The vertical movement guide portion is provided with a limit hole matched with the elastic clamp base vertical movement limit pin B4. The elastic clamp positioning mechanism of the inner barrel assembly of the wire-line core drilling tool of the present invention is further provided with the elastic clamp base reset spring W2. The elastic clamp base reset spring W2 is sleeved outside the elastic clamp rack 1-4. The upper and lower ends of the elastic clamp base reset spring W2 abut against the bottom face of the elastic caliper mounting portion of the elastic clamp base 1-7 and the annular stepped end face 1-4-5 disposed on the elastic clamp rack 1-4, respectively.

Referring to FIGS. 3 and 7, according to the elastic clamp positioning mechanism of the inner barrel assembly of the wire-line core drilling tool of the present invention, the middle portion of the support plate 1-8 of the elastic clamp positioning mechanism is provided with the recovery barrel guide pin avoidance hole 1-8-2. The support plate reset clamp spring W3 is mounted on the support plate 1-8.

Referring to FIGS. 3 to 8, according to the elastic clamp positioning mechanism 1 of the inner barrel assembly of the wire-line core drilling tool of the present invention, when the elastic caliper 1-6 is not fully stuck during the complete formation drilling process, the elastic caliper 1-6 can turn back towards the inside of the elastic clamp rack 1-4 when the inner barrel is salvaged, and a normal recovery is carried out after the elastic clamp limit is released to complete the salvage job of the inner assembly. When core blockage occurs in drilling in complex strata, the elastic caliper 1-6 is thrust upward, the elastic caliper 1-6 is fully stuck against the elastic clamp retaining head 7 in the outer barrel assembly, then the elastic caliper 1-6 and the elastic clamp base 1-7 are forced downward to squeeze the left and right parts of the support plate 1-8 to open to both sides until the lower edge of the recovery barrel guide pin avoidance hole 1-8-2 on the support plate 1-8 is in contact with the recovery barrel guide pin B5, so that the positions of the elastic clamp base 1-7 and the elastic caliper 1-6 are limited through the support plate 1-8 (as shown in state I in FIG. 8). After starting to salvage the inner barrel, a salvaging device hooks the spear head component 1-1 to drive the recovery barrel 1-2 to move up an empty stroke L1=9.7 mm, the recovery barrel guide pin B5 follows the recovery barrel 1-2 to move up the stroke L1=9.7 mm, the limiting function of the support plate 1-8 is released, a rigid knot formed after the full stuck is dissolved at this time, and the elastic clamp base 1-7 can move down (as shown in state II in FIG. 12). The recovery barrel 1-2 continues to move up L2=4.6 mm, and in this process, the recovery barrel 1-2 drives the elastic caliper 1-6 to rotate inward through the elastic clamp limit block hinge shaft B2 and the elastic caliper limit block 1-5, and the elastic clamp base 1-7 is forced downward at the same time, that is, the elastic caliper hinge shaft B3 moves down, the elastic clamp base reset spring W2 is further compressed, and the support plate 1-8 rotates to both sides to release space (as shown in state III in FIG. 8). After the elastic caliper 1-6 rotates over a dead center, the elastic clamp base 1-7 is reset under an elastic force of the elastic clamp base reset spring W2, and the support plate 1-8 is reset under an elastic force of the support plate reset clamp spring W3. The recovery barrel 1-2 continues to move up for a certain distance L3=14 mm, the inward recovery of the elastic caliper 1-6 is accomplished, and the elastic clamp limiting function is released, so that the salvage of the inner barrel assembly can be realized (as shown in state IV in FIG. 8).

Figure 9:
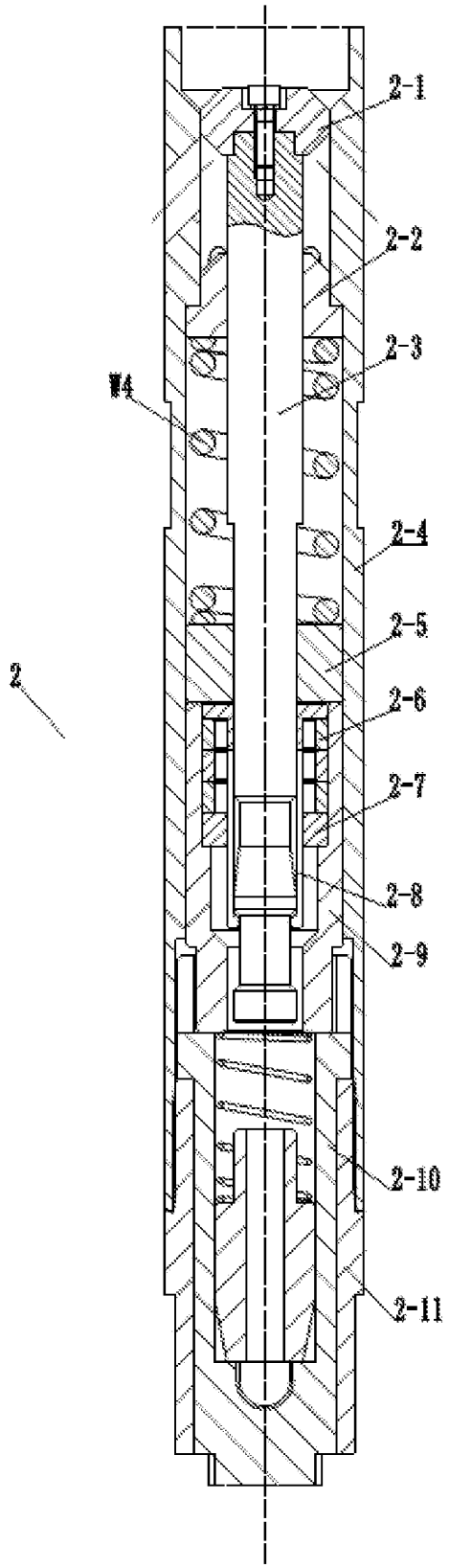
FIG. 9 is a schematic diagram of an in-place reporting and core blockage alarm mechanism.
Figure 11:
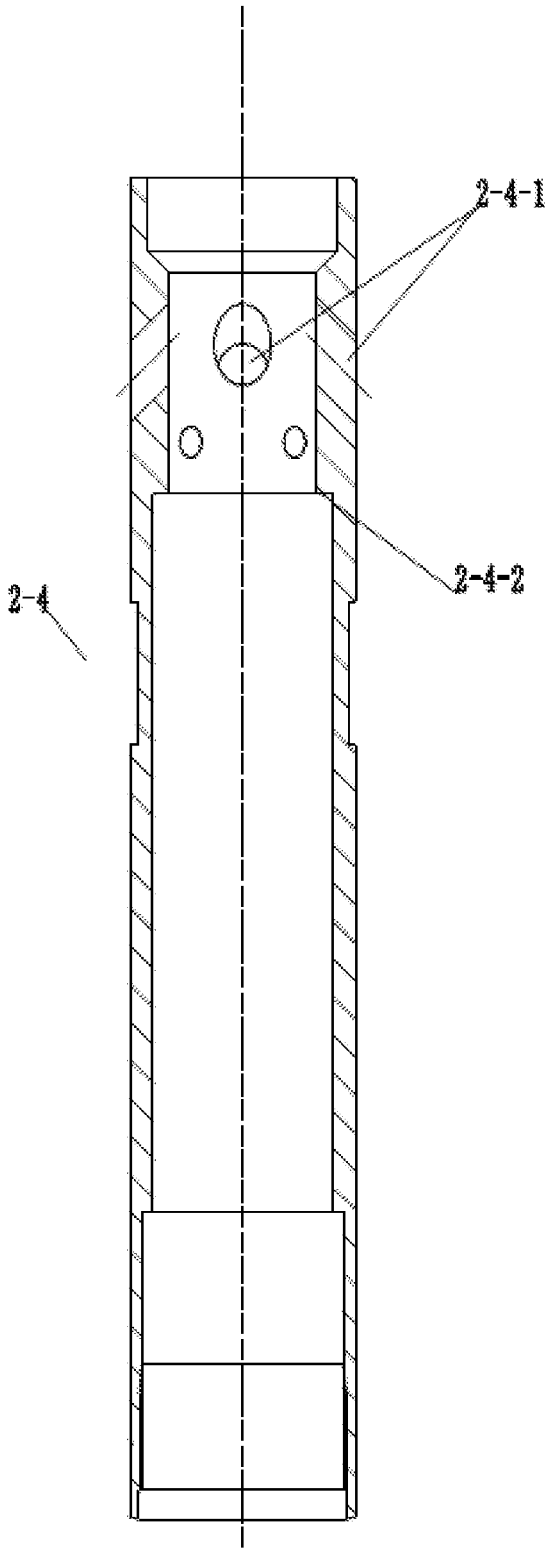
FIG. 11 is a schematic diagram of the structure of a water diversion sleeve in the in-place reporting and core blockage alarm mechanism.

Referring to FIGS. 9 and 11, according to the wire-line core drilling tool of the present invention, the in-place reporting and core blockage alarm mechanism 2 of the inner barrel assembly includes the valve core 2-1, the positioning sleeve 2-2, the valve stem 2-3, the water diversion sleeve 2-4, the lower limit block 2-5, the elastic clamp claw 2-8, the limit sleeve 2-7, the sliding sleeve 2-9, the torsion transmission joint 2-11, the adjusting bolt 2-10 and the core blockage alarm spring W4. A high-pressure overflow loop and a low-pressure overflow loop connected to a mud pump are disposed in a drilling fluid circulation system. The high-pressure overflow loop is provided with a high-pressure switch valve and a high-pressure overflow valve, and the low-pressure overflow loop is provided with a low-pressure switch valve and a low-pressure overflow valve. The valve core 2-1 is a plunger fixed on the upper end of the valve stem 2-3, and the diameter of the outer cylindrical face of the valve core is matched with the inner diameter of the upper portion of the water diversion sleeve 2-4. The upper end of the water diversion sleeve 2-4 is assembled with the elastic clamp positioning mechanism 1, and the lower end of the water diversion sleeve 2-4 is connected to the single-action mechanism 3 through the torsion transmission joint 2-11 and the adjusting bolt 2-10. The side wall of the upper end of the water diversion sleeve 2-4 is provided with the overflow hole 2-4-1 in communication with a drilling fluid channel. The valve stem 2-3 is placed inside the water diversion sleeve 2-4. The positioning sleeve 2-2, the core blockage alarm spring W4, the lower limit block 2-5 and the elastic clamp claw 2-8 are successively arranged in the annular space between the valve stem 2-3 and the water diversion sleeve 2-4 from top to bottom. The valve stem 2-3 moves up and down in the water diversion sleeve 2-4 to drive the valve core 2-1 to switch a blocking state and an opening state of the overflow hole 2-4-1 in the water diversion sleeve 2-4. The sliding sleeve 2-9 is sleeved outside the elastic clamp claw 2-8. The limit sleeve 2-7 is fitted between the sliding sleeve 2-9 and the elastic clamp claw 2-8, and an elastic force of the elastic clamp claw 2-8 is controlled through the limit sleeve 2-7.

Figure 10:
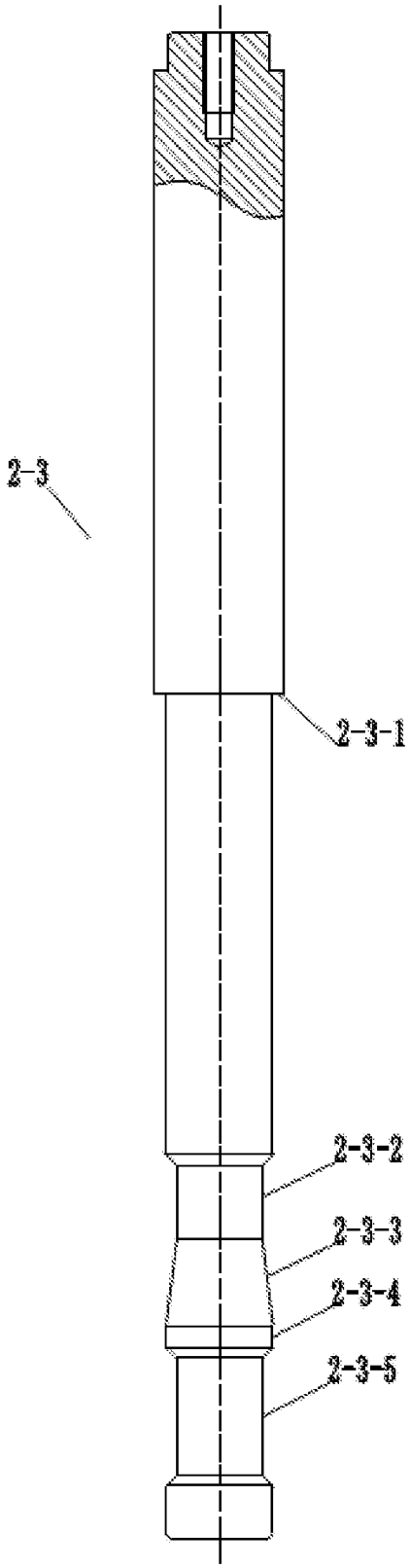
FIG. 10 is a schematic diagram of the structure of a valve stem in the in-place reporting and core blockage alarm mechanism.

Referring to FIGS. 9 and 10, according to the wire-line core drilling tool of the present invention, in the in-place reporting and core blockage alarm mechanism 2, the valve stem 2-3 is a cylindrical rod with variable sections. The middle portion of the valve stem 2-3 is provided with the annular limit face 2-3-1 matched with the lower limit block 2-5. The upper annular clamp groove 2-3-2, the tapered transition face 2-3-3, the annular boss 2-3-4, and the lower annular clamp groove 2-3-5 are successively disposed at the lower half of the valve stem 2-3 from top to bottom.

Referring to FIGS. 9 and 11, according to the wire-line core drilling tool of the present invention, in the in-place reporting and core blockage alarm mechanism 2, the inner side wall of the water diversion sleeve 2-4 is provided with the positioning boss 2-4-2 matched with the positioning sleeve 2-2, and the positioning boss 2-4-2 is located below the overflow hole 2-4-1.

Figure 12:
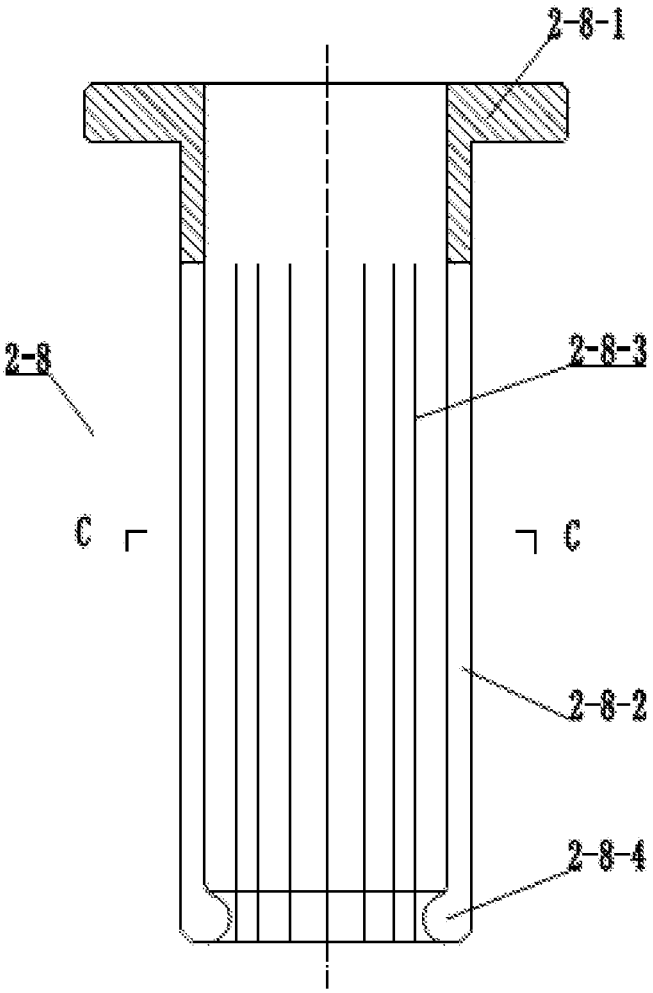
FIG. 12 is a schematic diagram of the structure of an elastic clamp claw in the in-place reporting and core blockage alarm mechanism.
Figure 13:
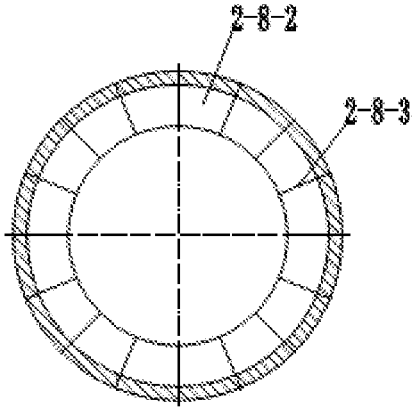
FIG. 13 is a cross-sectional view of the structure along C-C in FIG. 12.

Referring to FIGS. 9, 12 and 13, according to the wire-line core drilling tool of the present invention, in the in-place reporting and core blockage alarm mechanism 2, the elastic clamp claw 2-8 is a sleeve. Specifically, the upper end of the sleeve is provided with the disklike flange 2-8-1, and the lower end of the sleeve is divided into a plurality of clamp claw units 2-8-2 by a set of uniformly arranged slicing slits 2-8-3. The chuck 2-8-4 with a spherical structure is disposed at the lower end of each clamp claw unit 2-8-2.

Referring to FIG. 9, according to the wire-line core drilling tool of the present invention, a set of adjusting sleeves 2-6 for adjusting the upper and lower positions of the limit sleeve 2-7 is further provided in the in-place reporting and core blockage alarm mechanism 2, and a clamping table is disposed on the inner wall of the sliding sleeve 2-9. The adjusting sleeves 2-6 are sleeved outside the elastic clamp claw 2-8 in a clearance fit, and are arranged between the disklike flange 2-8-1 of the elastic clamp claw 2-8 and the clamping table of the sliding sleeve 2-9.

Figure 14:
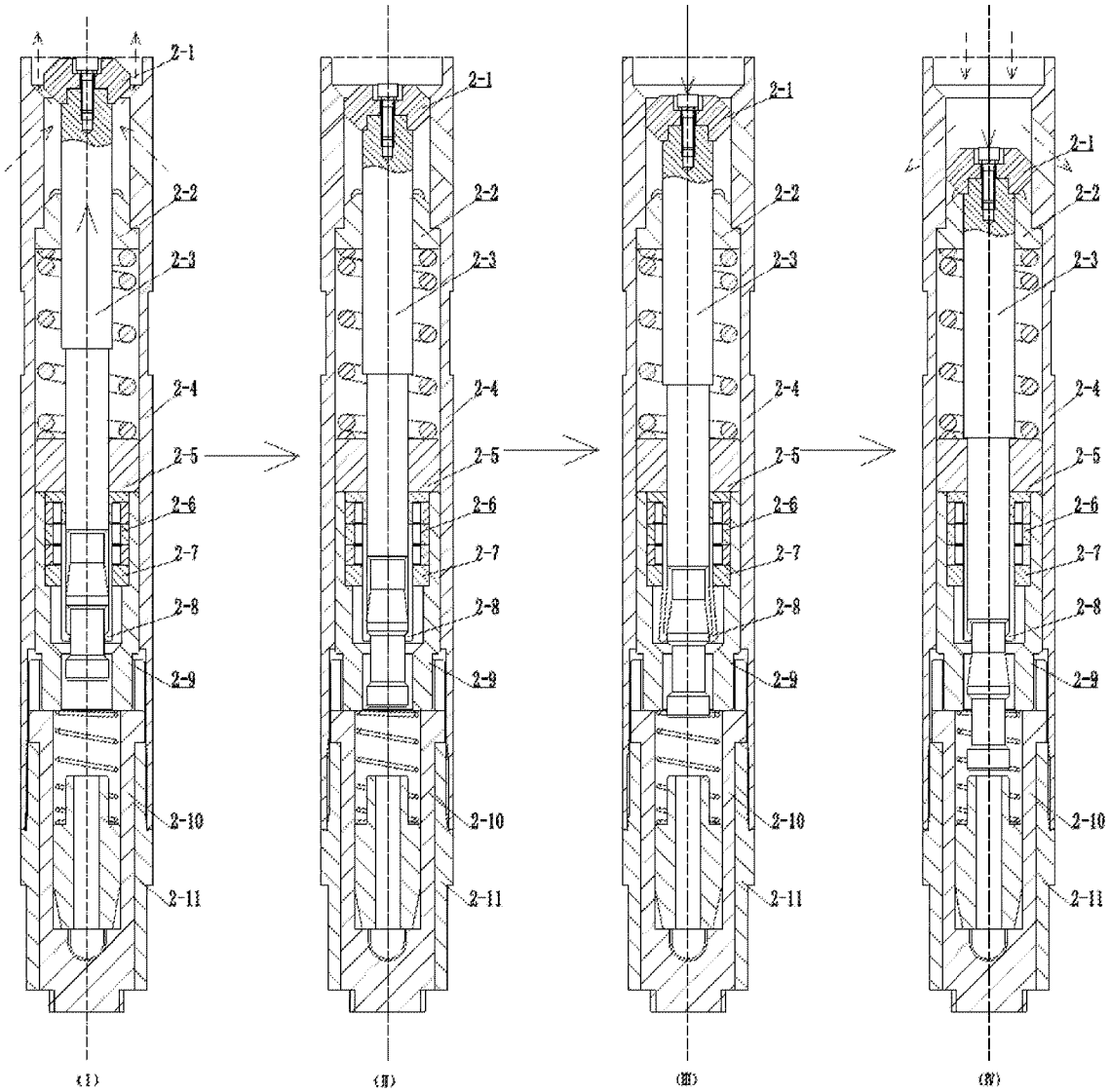
FIG. 14 is a schematic diagram of a working process of an in-place reporting of the in-place reporting and core blockage alarm mechanism.

Referring to FIG. 14, according to the wire-line core drilling tool of the present invention, the in-place reporting working process of the in-place reporting and core blockage alarm mechanism 2 is as follow. An overflow pressure value of the high-pressure overflow loop is set to be PA, and an overflow pressure value of the low-pressure overflow loop is set to be PB. A pressure of the mud pump is mainly the resistance of the drilling fluid circulating in the hole during drilling, and the pressure value of the mud pump is set to be PC. The annular boss 2-3-4 of the valve stem 2-3 can pass through an inner hole enclosed by the chuck 2-8-4 at the lower end of the elastic clamp claw 2-8 under the action of the pressure of the mud pump, and the corresponding pressure value of the mud pump at this time is set to be PD. During core drilling, the circulating pressure PC in the previous drilling is recorded, and respective pressure values are set in an order of PA>PD>PB>PC according to the size of the PC value. Upon delivering the inner assembly of the drilling tool, first, the low-pressure switch valve in the low-pressure overflow loop is opened, the high-pressure switch valve in the high-pressure overflow loop is closed, and the mud pump is turned on. After starting delivering the inner barrel assembly, the valve stem 2-3 is forced to move up, and a drilling fluid overflow channel inside the drilling tool is opened, so that a drilling fluid overflow area is increased, and a delivering speed of the inner barrel assembly is increased (as shown in state I in FIG. 14, wherein the dashed arrow indicates the flow direction of the drilling fluid and the solid arrow indicates the direction of a resultant force of the drilling fluid acting on the valve stem 2-3). After the inner barrel assembly is delivered in place (i.e., the suspension ring 1-9 is in contact with the ring base 10 and in place), the lower annular clamp groove 2-3-5 of the valve stem 2-3 is in contact with the chuck 2-8-4 of the elastic clamp claw 2-8. At the position of the valve core 2-1, the overflow hole 2-4-1 in communication with the drilling fluid overflow channel inside the drilling tool is blocked (as shown in state II in FIG. 14). At this time, the mud pump starts to build up a pressure, and since PD>PB>PC, the low-pressure overflow valve in the low-pressure overflow loop connected to the mud pump overflows to relieve the pressure. At this time, the earth's surface phenomenon is obvious and is persistent, and during this process, the value of the pump pressure gauge gradually increases to PB. Through the phenomenon of earth's surface overflow and the numerical change of the pump pressure gauge, an operator can determine that the inner barrel assembly is in place, and then control the mud pump to stop running. The low-pressure switch valve in the low-pressure overflow loop is closed, the high-pressure switch valve in the high-pressure overflow loop is opened, and the mud pump is turned on again. Since PA>PD, under the action of the pressure of the mud pump, the valve core 2-1 and the valve stem 2-3 are forced to move down, and the elastic clamp claw 2-8 is forced to unfold until the annular boss 2-3-4 and the tapered transition face 2-3-3 of the valve stem 2-3 successively pass through the chuck 2-8-4, and the chuck 2-8-4 is clamped in the upper annular clamp groove 2-3-2 of the valve stem 2-3 (this process is shown in state III in FIG. 14). At this time, the elastic clamp claw 2-8 is in an unfolding state, and when the valve core 2-1 is in contact with the positioning sleeve 2-2, the drilling fluid overflow channel inside the drilling tool is opened (as shown in state IV in FIG. 14). The earth's surface phenomenon is that the drilling fluid returns from an orifice, and is persistent. The reading of the pump pressure gauge increases to PD and then decreases to PC. The operator can perform a comprehensive analysis through the above two phenomena, reconfirm that the inner barrel assembly is in place, make accurate judgment, and then start the core drilling. As the drilling deepens gradually, the circulating pressure PC gradually increases, so it is necessary to gradually increase the values of PA, PB and PD, in which PA and PB can be adjusted by adjusting a set value of the high-pressure overflow valve and a set value of the low-pressure overflow valve, and PD can be adjusted through the change of an effective length of a bending arm of the elastic clamp claw 2-8 by adjusting the relative position of the limit sleeve 2-7 and the adjusting sleeve 2-6, so as to adjust the pressure of the drilling fluid matched with the elastic force of the elastic clamp claw 2-8.

Figure 15:
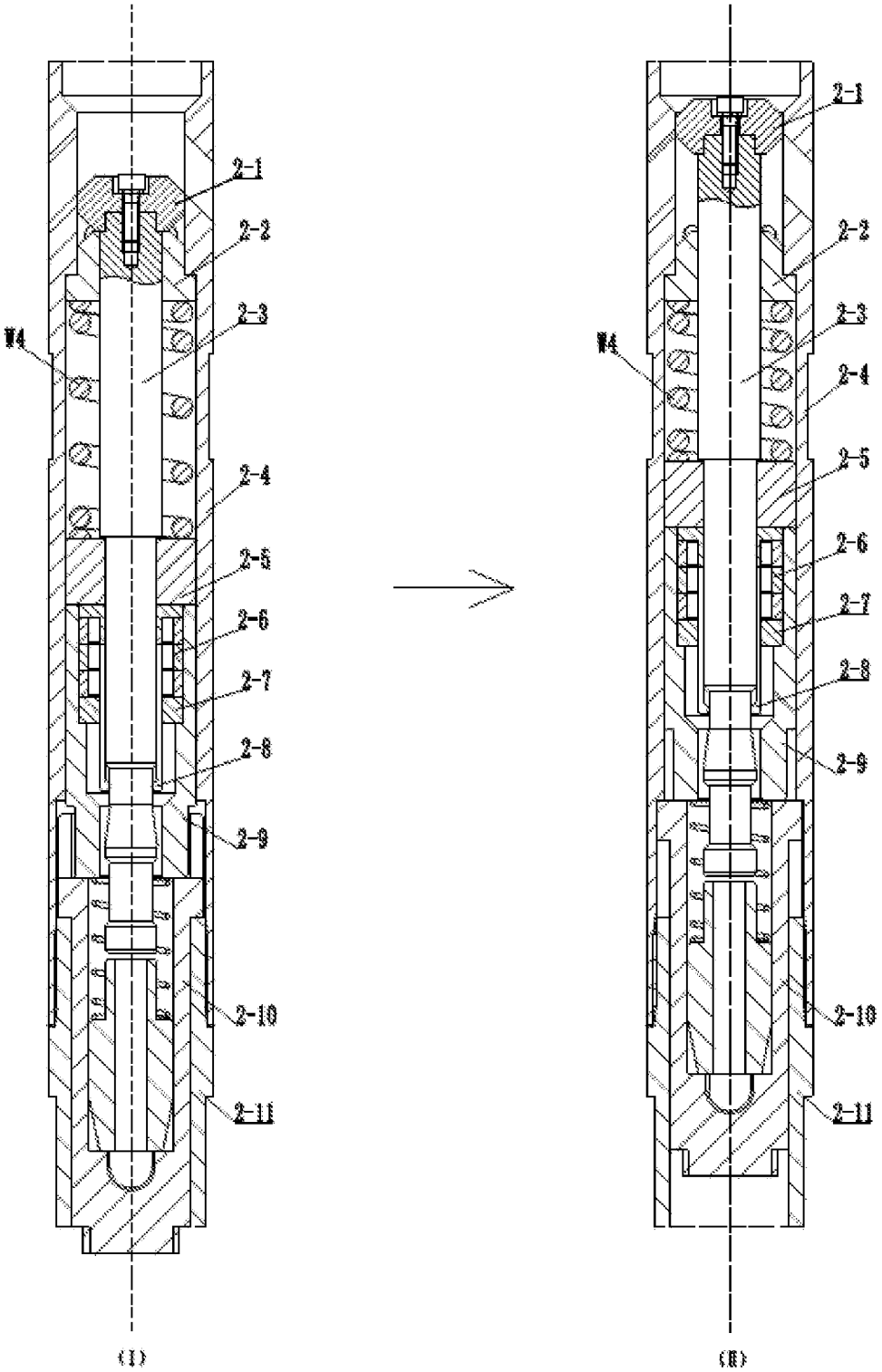
FIG. 15 is a schematic diagram of a working process of a core blockage alarm of the in-place reporting and core blockage alarm mechanism.

Referring to FIG. 15, according to the wire-line core drilling tool of the present invention, the core blockage alarm working process of the in-place reporting and core blockage alarm mechanism 2 is as follows. During the normal drilling of the drilling tool, the low-pressure switch valve in the low-pressure overflow loop is in a closed state, the high-pressure switch valve in the high-pressure overflow loop is in an opening state. After the core blockage phenomenon occurs in the core barrel, an upward pressure of the core barrel is transmitted to the core blockage alarm spring W4 via the adjusting bolt 2-10, the sliding sleeve 2-9 and the lower limit block 2-5 to compress the core blockage alarm spring W4, and drives the valve core 2-1 and the valve stem 2-3 to move up at the same time. The valve core 2-1 blocks the overflow hole 2-4-1 in the water diversion sleeve 2-4 in communication with the drilling fluid channel (as shown in state II in FIG. 15), so that the pressure of the mud pump rises until the pressure reaches the overflow pressure set value PA of the high-pressure overflow loop, and the high-pressure overflow valve overflows to relieve the pressure. Through the persistent overflow phenomenon and the numerical change of mud pump pressure gauge, the operator can accurately determine the core blockage in the hole, and the operators can be timely and accurately guided to carry out the next operation, i.e., salvaging the inner barrel, so as to avoid core wear and consumption and ensure core recovery quality. After the coring operation is accomplished, the valve core 2-1 and the valve stem 2-3 need to be manually reset. All relevant parts can be reset through specialized reset tools to restore to the state I shown in FIG. 15.

Figure 16:
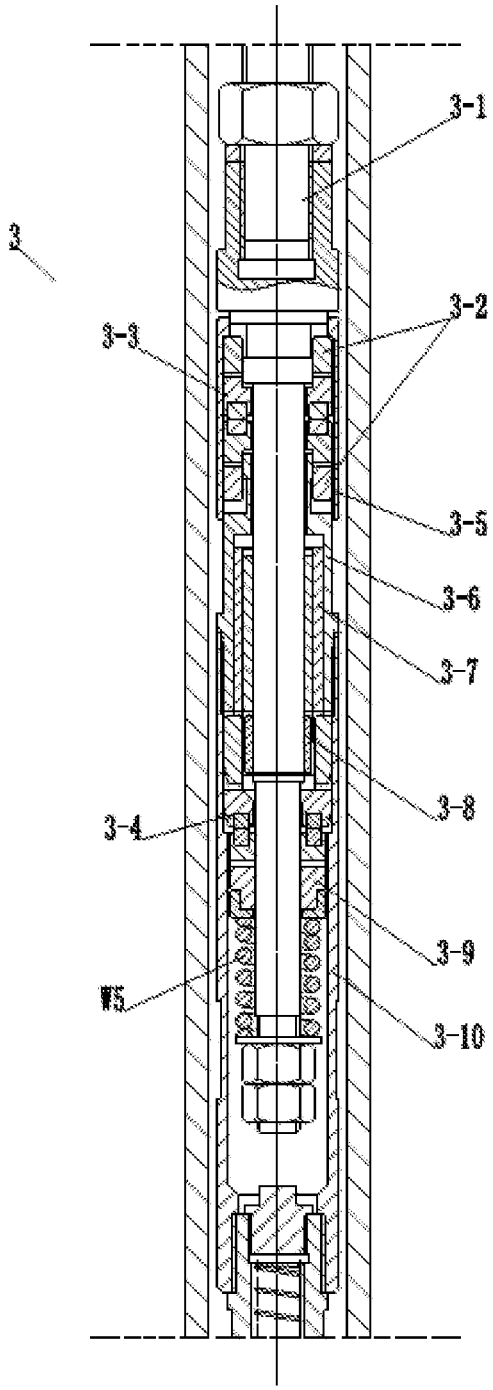
FIG. 16 is a schematic diagram of a single-action mechanism.

Referring to FIG. 16, according to the wire-line core drilling tool of the present invention, the single-action mechanism 3 includes the mandrel 3-1, the upper PDC bearing 3-3, the bearing protective cover 3-5, the single-action joint 3-6, the TC bearing 3-7, the TC bearing limit member 3-8, the lower PDC bearing 3-4, the positioning half-ring 3-9, and the connecting sleeve 3-10. The mandrel 3-1 is fixedly assembled with the adjusting bolt 2-10 of the in-place reporting and core blockage alarm mechanism 2. The upper PDC bearing 3-3, the single-action joint 3-6, the TC bearing 3-7, the TC bearing limit member 3-8, the lower PDC bearing 3-4 and the positioning half-ring 3-9 are sleeved outside the mandrel 3-1. The protective gasket 3-2 is disposed at each of an upper end and a lower end of the upper PDC bearing 3-3. The bearing protective cover 3-5 is disposed outside the upper PDC bearing 3-3 and the protective gasket 3-2. The single-action joint 3-6, the connecting sleeve 3-10, the upper PDC bearing 3-3, the TC bearing 3-7 and the lower PDC bearing 3-4 are fitted. The lower end of the connecting sleeve 3-10 is fixedly connected to the core barrel check valve mechanism 4.

Figure 17:
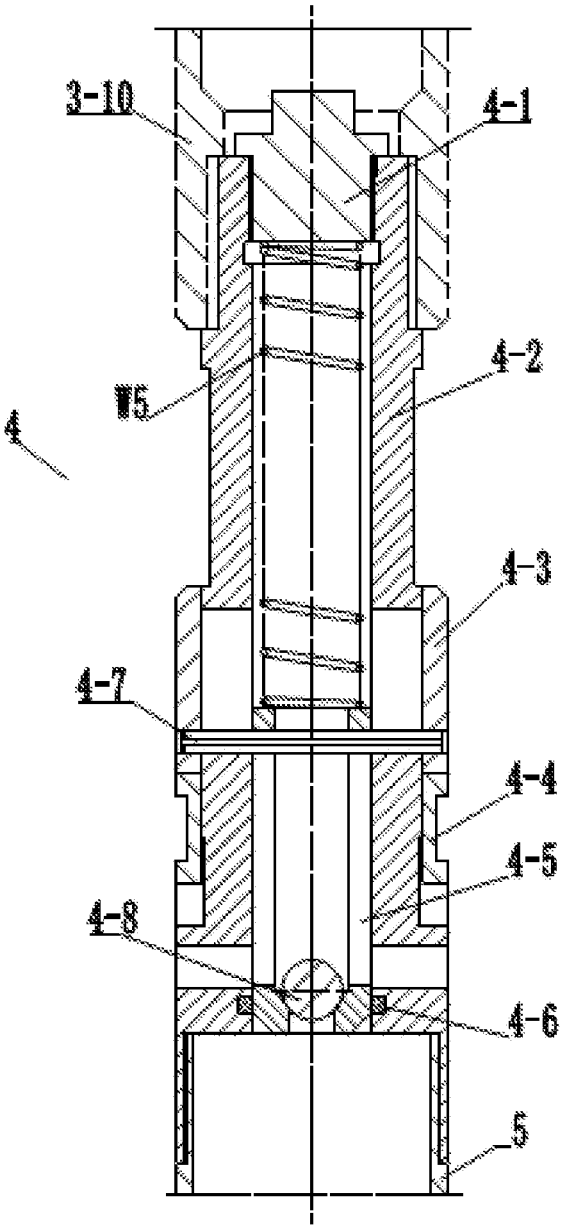
FIG. 17 is a schematic diagram of a core barrel check valve mechanism.
Figure 23:
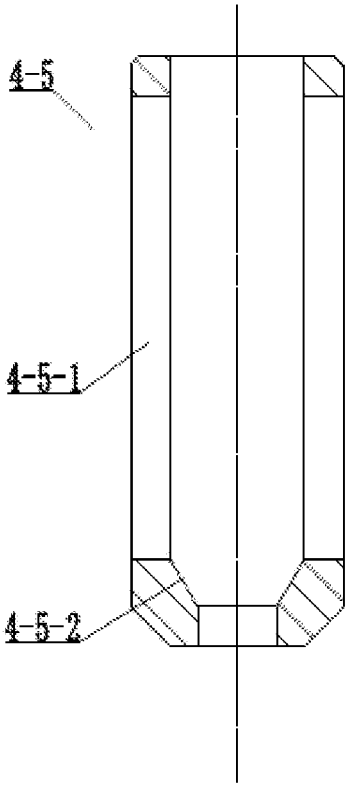
FIG. 23 is a schematic diagram of the structure of a liftable valve base in the core barrel check valve mechanism.
Figure 24:
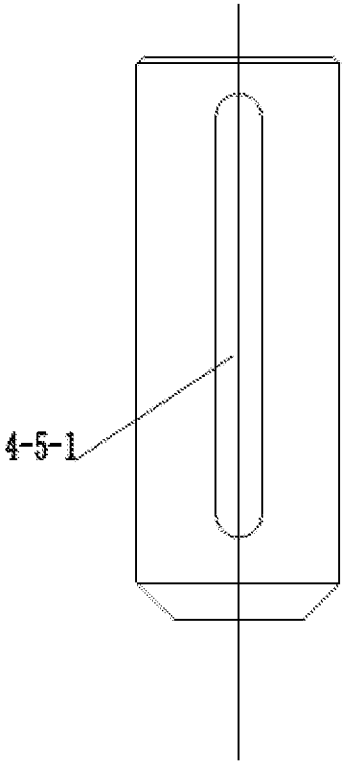
FIG. 24 is a side view of FIG. 23.

Referring to FIGS. 17, 23 and 24, according to the wire-line core drilling tool of the present invention, the core barrel check valve mechanism 4 includes the core barrel joint 4-2, the thrust sleeve 4-3, the liftable valve base 4-5, the cylindrical pin 4-7 and the steel ball 4-8. The core barrel joint 4-2 is provided with the inner hole 4-2-7 penetrating vertically and the liquid discharge hole 4-2-4 penetrating perpendicularly to the inner hole. The upper end and the lower end of the core barrel joint 4-2 are assembled with the single-action mechanism 3 and the core barrel 5, respectively. The thrust sleeve 4-3 is sleeved outside the core barrel joint 4-2, and two cylindrical pin avoidance holes 4-2-2 are symmetrically disposed in the middle portion of the side wall of the core barrel joint 4-2. The thrust sleeve 4-3 is cylindrical, and the cylindrical pin 4-7 is fitted on the thrust sleeve 4-3. Two ends of the cylindrical pin 4-7 pass through the cylindrical pin avoidance holes 4-2-2 of the core barrel joint 4-2 and are then assembled with pin holes disposed in the side wall of the thrust sleeve 4-3. The liftable valve base 4-5 is a sleeve, and the lower end of the liftable valve base 4-5 is provided with the tapered opening 4-5-2. The liftable valve base 4-5 is placed in the inner hole 4-2-7 of the core barrel joint 4-2 and can move up and down axially. The side wall of the liftable valve base 4-5 is provided with the axial long hole 4-5-1. When the liftable valve base 4-5 is in a lower level, the axial long hole 4-5-1 is in communication with the liquid discharge hole 4-2-4 at the lower portion of the core barrel joint. The steel ball 4-8 is placed in the liftable valve base 4-5, and the steel ball cooperates with the tapered opening 4-5-2 at the lower end of the liftable valve base 4-5 to realize a sealing function.

Referring to FIGS. 17-22, according to the wire-line core drilling tool of the present invention, the core barrel check valve mechanism 4 is further provided with a liftable valve base positioning assembly. The liftable valve base positioning assembly includes the transposition sleeve 4-4, and axial slots disposed in the outer wall of the core barrel joint 4-2. The transposition sleeve 4-4 is sleeved outside the core barrel joint 4-2, and is located under the thrust sleeve 4-3. The outer side wall of the transposition sleeve 4-4 is provided with the annular holding groove 4-4-1. The side wall of the transposition sleeve 44 is symmetrically provided with two positioning insert blocks 4-4-2 matched with the axial slots in the outer wall of the core barrel joint 4-2 and extending downwardly. The axial slots disposed in the outer wall of the core barrel joint 4-2 include two sets, wherein one set is the high-level slots 4-2-3 located above the liquid discharge hole 4-2-4, and the other set is the low-level slots 4-2-5 having a rotation angle of 90° with the high-level slots 4-2-3.

Figure 18:
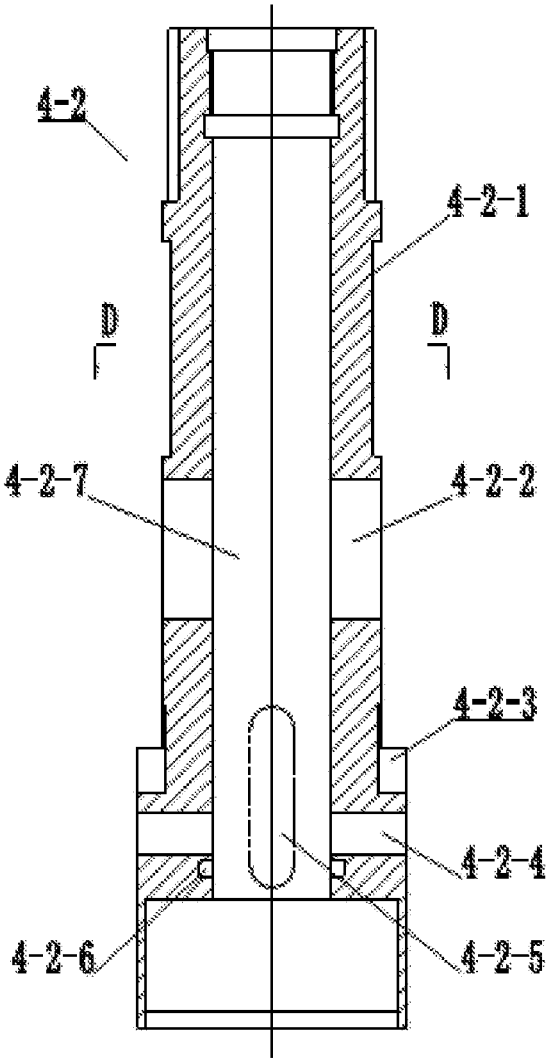
FIG. 18 is a schematic diagram of the structure of a core barrel joint in the core barrel check valve mechanism.
Figure 19:
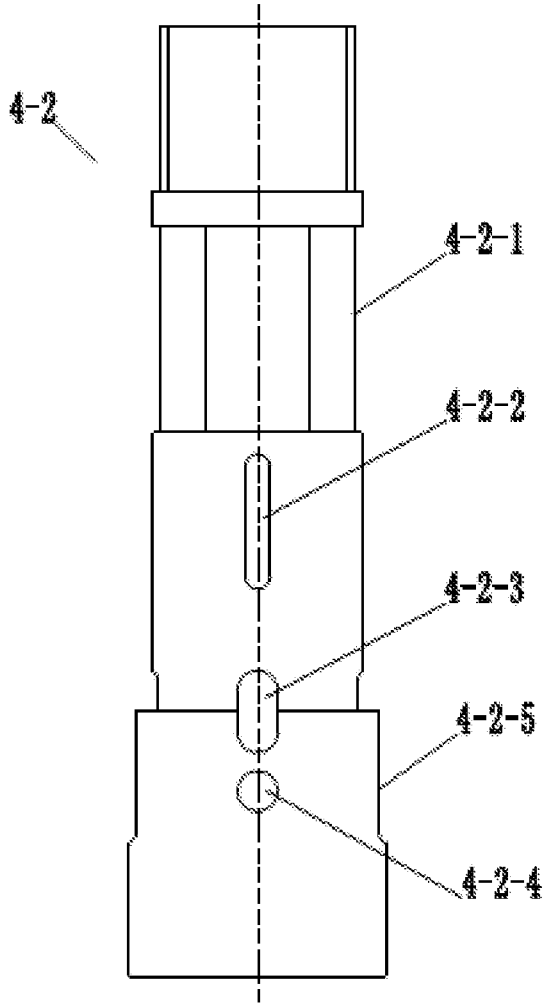
FIG. 19 is a side view of FIG. 18.
Figure 20:
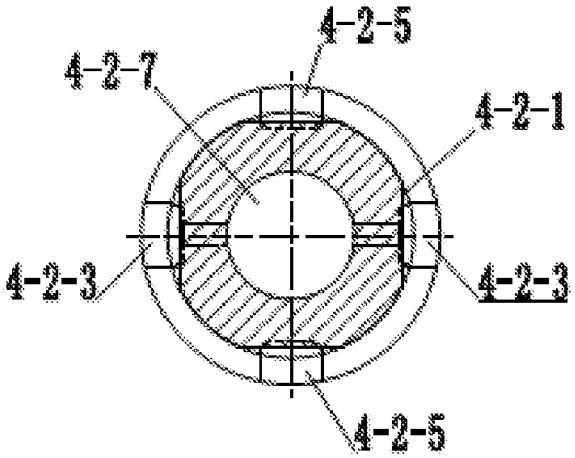
FIG. 20 is a cross-sectional view of the structure along D-D in FIG. 18.
Figure 21:
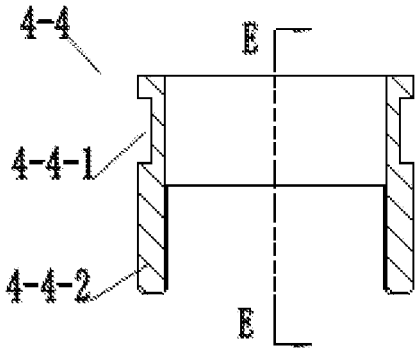
FIG. 21 is a schematic diagram of the structure of a transposition sleeve in the core barrel check valve mechanism.
Figure 22:
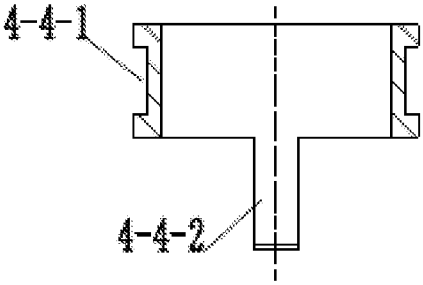
FIG. 22 is a cross-sectional view of the structure along E-E in FIG. 21.

Referring to FIGS. 17 and 18, according to the wire-line core drilling tool of the present invention, the core barrel check valve mechanism 4 is further provided with a liftable valve base resetting and compressing assembly. The liftable valve base resetting and compressing assembly includes the liftable valve base reset spring W5 and the plug 4-1. The plug 4-1 is threadedly connected at the upper end of the core barrel joint 4-2. The liftable valve base reset spring W5 is sleeved in the inner hole 4-2-7 of the core barrel joint 4-2, and is installed between the bottom face of the plug 4-1 and the upper end face of the liftable valve base 4-5 in a pre-compression mode.

Figure 25:
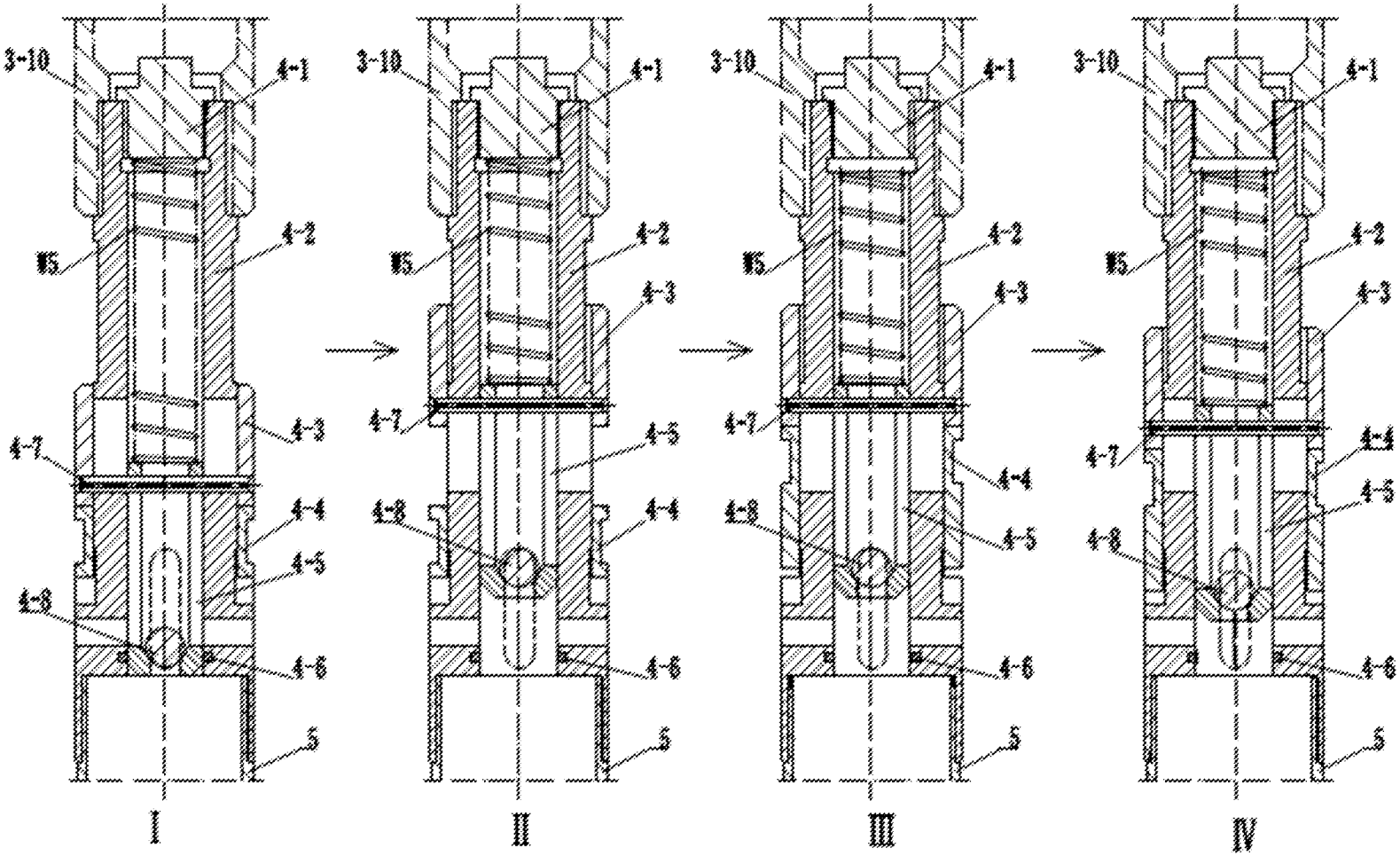
FIG. 25 is a schematic diagram of a working process of the core barrel check valve mechanism.

Referring to FIG. 25, according to the wire-line core drilling tool of the present invention, the working process of the core barrel check valve mechanism 4 is as follows. In the drilling process of the wire-line core drilling tool, the cylindrical pin 4-7 installed on the thrust sleeve 4-3 is carried on the bottom of the cylindrical pin avoidance hole 4-2-2 of the core barrel joint 4-2. The two positioning insert blocks 4-4-2 of the transposition sleeve 4-4 are clamped into the two low-level slots 4-2-5 of the core barrel joint 4-2. The liftable valve base 4-5 is in a low level under the gravity of itself and the steel ball 4-8 and a pre-compression force of the liftable valve base reset spring W5. At this time, the core barrel 5 is blocked. As the core enters the core barrel 5, the steel ball 4-8 is pushed to move upward to be separated from the tapered opening 2-5-2 of the liftable valve base 4-5, so that the check valve is opened and the flushing fluid inside the core barrel 5 is discharged. When the inner barrel is salvaged, under the action of the flushing fluid and the gravity of the steel ball 4-8 itself, the steel ball 4-8 falls back to the tapered opening 4-5-2 of the liftable valve base 4-5, so that the check valve is closed, and the core in the barrel is in a closed and pressure-sustaining state. During the earth's surface core exiting job, the liftable valve base 4-5 in the core barrel check valve mechanism 4 salvaged onto the ground is at a low level, the steel ball 4-8 is located at the tapered opening 4-5-2 of the liftable valve base 4-5, the check valve is closed, and the two positioning insert blocks 4-4-2 of the transposition sleeve 4-4 are clamped into the two low-level slots 4-2-5 of the core barrel joint 4-2 (as shown in state I in FIG. 25). The operator can move the thrust sleeve 4-3 upwards by one hand, and the thrust sleeve 4-3 drives the cylindrical pin 4-7 to move to the top of the cylindrical pin avoidance hole 4-2-2. At this time, the liftable valve base 4-5 is raised to a high level through the cylindrical pin 4-7, and the liftable valve base reset spring W5 is further compressed (as shown in state II in FIG. 25). Then, the other hand of the operator pushes the transposition sleeve 4-4 upwardly via the annular holding groove 4-4-1 on the outer wall of the transposition sleeve 4-4, so that the two positioning insert blocks 4-4-2 of the transposition sleeve 4-4 are separated from the two low-level slots 4-2-5 of the core barrel joint 4-2. The transposition sleeve 4-4 is rotated 90 degrees to enable the two positioning insert blocks 4-4-2 of the transposition sleeve 4-4 to slide into the high-level slots 4-2-3 of the core barrel joint (as shown in state III in FIG. 25). Then, the two hands of the operator loosen the thrust sleeve 4-3 and the transposition sleeve 4-4, respectively, and the thrust sleeve 4-3 and the liftable valve base 4-5 move downward under the action of the elastic force of the liftable valve base reset spring W5 until the thrust sleeve 4-3 contacts the transposition sleeve 4-4 (as shown in state IV in FIG. 25). At this time, the upper end of the core barrel 5 is in an opening state, and the pressure relief channel is formed to eliminate the negative pressure that may be generated at the upper end of the core barrel, making it easier for cores drilled in complex formations to exit the barrel.

Figure 26:
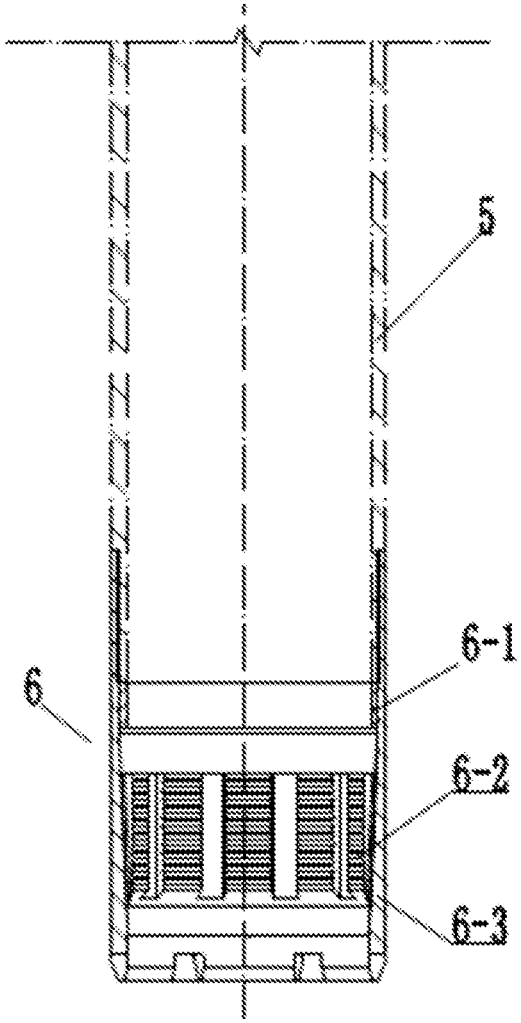
FIG. 26 is a schematic diagram of a core-breaking mechanism.

Referring to FIG. 26, according to the wire-line core drilling tool of the present invention, the core-breaking mechanism 6 includes the retaining ring 6-1, the clamp spring 6-2 and the clamp spring base 6-3. The clamp spring base 6-3 is a sleeve fixedly connected to the lower end of the core barrel 5. The lower portion of the inner side wall of the clamp spring base is a tapered face matched with the clamp spring. The clamp spring 6-2 is fitted in the clamp spring base 6-3, and the retaining ring 6-1 is arranged above the clamp spring 6-2. The retaining ring 6-1 is an enclosed ring structure, and the clamp spring 6-2 is axially limited through the retaining ring 6-1.

Referring to FIG. 1, according to the wire-line core drilling tool, the length of the inner barrel assembly can be adjusted by the cooperation between the adjusting bolt 2-10 in the in-place reporting and core blockage alarm mechanism 2 and the mandrel 3-1 in the single-action mechanism 3.

What is claimed is:

1. A wire-line core drilling tool, comprising an outer barrel assembly and an inner barrel assembly; wherein the inner barrel assembly is, from top to bottom, successively provided with an elastic clamp positioning mechanism, an in-place reporting and core blockage alarm mechanism, a single-action mechanism, a core barrel check valve mechanism, a core barrel and a core-breaking mechanism;

the elastic clamp positioning mechanism adopts a multi-point hinged mode;

the single-action mechanism adopts a cooperating structure of an upper polycrystalline diamond compact (PDC) bearing, a lower PDC bearing and a tungsten carbide (TC) bearing arranged in a middle;

the core barrel check valve mechanism controls an opening and a closing of a check valve through a cooperation between a steel ball and a liftable valve base;

during a drilling of the wire-line core drilling tool, the inner barrel assembly is placed in the outer barrel assembly, and during a coring operation, the inner barrel assembly is lifted from the outer barrel assembly to the ground by a salvage device;

the outer barrel assembly is provided with an elastic clamp retaining head, an elastic clamp chamber, an upper reamer, an outer barrel, a lower reamer and a drill bit, wherein the elastic clamp retaining head, the elastic clamp chamber, the upper reamer, the outer barrel, the lower reamer and the drill bit are successively assembled from top to bottom;

a ring base is embedded in an annular groove formed between a lower end of the elastic clamp chamber and an inner side wall of the upper reamer, and a centralizing ring is embedded in an annular groove formed between a lower end of the outer barrel and an inner side wall of the lower reamer; and the elastic clamp retaining head, the elastic clamp chamber and the ring base cooperate with the elastic clamp positioning mechanism in the inner barrel assembly to switch a locking state and an unlocking state of the inner barrel assembly and the outer barrel assembly.

2. The wire-line core drilling tool according to claim 1, wherein the elastic clamp positioning mechanism of the inner barrel assembly comprises a spear head component, a recovery barrel, an elastic clamp rack, an elastic clamp limit block, an elastic caliper, an elastic clamp base and a support plate;

an upper end of the recovery barrel is assembled with the spear head component;

the elastic clamp rack is sleeved in the recovery barrel, and two elastic caliper avoidance holes are symmetrically disposed in a side wall of the recovery barrel;

the elastic clamp rack is a sleeve with axial long holes formed on both sides;

a bottom of the elastic clamp rack is fixedly assembled with the in-place reporting and core blockage alarm mechanism;

the elastic clamp limit block, the elastic caliper, the elastic clamp base and the support plate are arranged in the elastic clamp rack, wherein each of the elastic clamp limit block, the elastic caliper and the support plate comprises two symmetrical parts on the left and right;

left and right parts of the elastic clamp limit block are hinged together through an elastic clamp limit block hinge shaft, and two ends of the elastic clamp limit block hinge shaft are mounted on the side wall of the recovery barrel;

the left and right parts of the elastic clamp limit block are further hinged and assembled with left and right parts of the elastic caliper, respectively;

the left and right parts of the elastic caliper are hinged together through an elastic caliper hinge shaft, and the elastic caliper hinge shaft is assembled with the elastic clamp base;

in an opening state of the elastic caliper, outer edges of the left and right parts of the elastic caliper pass through the elastic caliper avoidance holes in the side wall of the recovery barrel and are clamped in a clamp groove of the elastic clamp chamber of the outer barrel assembly of the wire-line core drilling tool;

the elastic clamp base moves up and down along a central axis of the elastic clamp rack, and a lower end of the elastic clamp base is in contact with the support plate;

left and right parts of the support plate are hinged together through a support plate hinge shaft, and the support plate hinge shaft is assembled with the elastic clamp rack; and an upper end of the support plate is provided with a wedge face matched with the lower end of the elastic clamp base.

3. The wire-line core drilling tool according to claim 2, wherein the in-place reporting and core blockage alarm mechanism comprises a valve core, a positioning sleeve, a valve stem, a water diversion sleeve, a lower limit block, an elastic clamp claw, a limit sleeve, a sliding sleeve, a torsion transmission joint, an adjusting bolt and a core blockage alarm spring;

a high-pressure overflow loop and a low-pressure overflow loop connected to a mud pump are disposed in a drilling fluid circulation system;

the valve core is a plunger fixed on an upper end of the valve stem, and a diameter of an outer cylindrical face of the valve core is matched with an inner diameter of an upper portion of the water diversion sleeve;

an upper end of the water diversion sleeve is assembled with the elastic clamp positioning mechanism, and a lower end of the water diversion sleeve is connected to the single-action mechanism through the torsion transmission joint and the adjusting bolt;

a side wall of the upper end of the water diversion sleeve is provided with an overflow hole in communication with a drilling fluid channel;

the valve stem is placed inside the water diversion sleeve;

the positioning sleeve, the core blockage alarm spring, the lower limit block and the elastic clamp claw are successively arranged in an annular space between the valve stem and the water diversion sleeve from top to bottom;

the valve stem moves up and down in the water diversion sleeve to drive the valve core to switch a blocking state and an opening state of the overflow hole in the water diversion sleeve;

the sliding sleeve is sleeved outside the elastic clamp claw; and the limit sleeve is fitted between the sliding sleeve and the elastic clamp claw, and an elastic force of the elastic clamp claw is controlled through the limit sleeve.

4. The wire-line core drilling tool according to claim 3, wherein the single-action mechanism comprises a mandrel, the upper PDC bearing, a bearing protective cover, a single-action joint, the TC bearing, a TC bearing limit member, the lower PDC bearing, a positioning half-ring, and a connecting sleeve;

the mandrel is fixedly assembled with the adjusting bolt of the in-place reporting and core blockage alarm mechanism;

the upper PDC bearing, the single-action joint, the TC bearing, the TC bearing limit member, the lower PDC bearing and the positioning half-ring are sleeved outside the mandrel;

a protective gasket is disposed at each of an upper end and a lower end of the upper PDC bearing;

the bearing protective cover is disposed outside the upper PDC bearing and the protective gasket;

the single-action joint, the connecting sleeve, the upper PDC bearing, the TC bearing and the lower PDC bearing are fitted; and a lower end of the connecting sleeve is fixedly connected to the core barrel check valve mechanism.

5. The wire-line core drilling tool according to claim 3, wherein the core barrel check valve mechanism comprises a core barrel joint, a thrust sleeve, a liftable valve base, a cylindrical pin and a steel ball;

the core barrel joint is provided with an inner hole penetrating vertically and a liquid discharge hole penetrating perpendicularly to the inner hole;

an upper end and a lower end of the core barrel joint are assembled with the single-action mechanism and the core barrel, respectively;

the thrust sleeve is sleeved outside the core barrel joint, and two cylindrical pin avoidance holes are symmetrically disposed in a middle portion of a side wall of the core barrel joint;

the thrust sleeve is cylindrical, and the cylindrical pin is fitted on the thrust sleeve;

two ends of the cylindrical pin pass through the cylindrical pin avoidance holes of the core barrel joint and are then assembled with pin holes disposed in a side wall of the thrust sleeve;

the liftable valve base is a sleeve, and a lower end of the liftable valve base is provided with a tapered opening;

the liftable valve base is placed in the inner hole of the core barrel joint and moves up and down axially;

a side wall of the liftable valve base is provided with an axial long hole;

when the liftable valve base is in a lower level, the axial long hole is in communication with the liquid discharge hole at a lower portion of the core barrel joint; and the steel ball is placed in the liftable valve base, and the steel ball cooperates with the tapered opening at the lower end of the liftable valve base to realize a sealing function.

6. The wire-line core drilling tool according to claim 3, wherein the core-breaking mechanism comprises a retaining ring, a clamp spring and a clamp spring base;

the clamp spring base is a sleeve fixedly connected to a lower end of the core barrel;

a lower portion of an inner side wall of the clamp spring base is a tapered face matched with the clamp spring;

the clamp spring is fitted in the clamp spring base, and the retaining ring is arranged above the clamp spring; and the retaining ring is an enclosed ring structure, and the clamp spring is axially limited through the retaining ring.

7. The wire-line core drilling tool according to claim 3, wherein a set of circumferentially arranged centralizing steel balls is fitted in the centralizing ring of the outer barrel assembly, and a centralizing steel ball limit sleeve is disposed outside the centralizing steel balls.

8. The wire-line core drilling tool according to claim 3, wherein a length of the inner barrel assembly is adjusted by a cooperation between the adjusting bolt in the in-place reporting and core blockage alarm mechanism and the mandrel in the single-action mechanism.

9. The wire-line core drilling tool according to claim 1, wherein the in-place reporting and core blockage alarm mechanism comprises a valve core, a positioning sleeve, a valve stem, a water diversion sleeve, a lower limit block, an elastic clamp claw, a limit sleeve, a sliding sleeve, a torsion transmission joint, an adjusting bolt and a core blockage alarm spring;

a high-pressure overflow loop and a low-pressure overflow loop connected to a mud pump are disposed in a drilling fluid circulation system;

the valve core is a plunger fixed on an upper end of the valve stem, and a diameter of an outer cylindrical face of the valve core is matched with an inner diameter of an upper portion of the water diversion sleeve;

an upper end of the water diversion sleeve is assembled with the elastic clamp positioning mechanism, and a lower end of the water diversion sleeve is connected to the single-action mechanism through the torsion transmission joint and the adjusting bolt;

a side wall of the upper end of the water diversion sleeve is provided with an overflow hole in communication with a drilling fluid channel;

the valve stem is placed inside the water diversion sleeve;

the positioning sleeve, the core blockage alarm spring, the lower limit block and the elastic clamp claw are successively arranged in an annular space between the valve stem and the water diversion sleeve from top to bottom;

the valve stem moves up and down in the water diversion sleeve to drive the valve core to switch a blocking state and an opening state of the overflow hole in the water diversion sleeve;

the sliding sleeve is sleeved outside the elastic clamp claw; and the limit sleeve is fitted between the sliding sleeve and the elastic clamp claw, and an elastic force of the elastic clamp claw is controlled through the limit sleeve.

* * * * *